US012668956B2

(12) United States Patent
Matsuyama

(10) Patent No.: US 12,668,956 B2
(45) Date of Patent: Jun. 30, 2026

(54) WORK MACHINE DIAGNOSIS DEVICE

(71) Applicant: Hitachi Construction Machinery Co., Ltd., Tokyo (JP)

(72) Inventor: Takuma Matsuyama, Abiko (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 100 days.

(21) Appl. No.: 18/687,389

(22) PCT Filed: Mar. 16, 2023

(86) PCT No.: PCT/JP2023/010459
§ 371 (c)(1),
(2) Date: Feb. 28, 2024

(87) PCT Pub. No.: WO2023/189683
PCT Pub. Date: Oct. 5, 2023

(65) Prior Publication Data

US 2024/0352713 A1 Oct. 24, 2024

(30) Foreign Application Priority Data

Mar. 29, 2022 (JP) ..... 2022-054419

(51) Int. Cl.
*E02F 9/26* (2006.01)
*E02F 9/22* (2006.01)

(52) U.S. Cl.
CPC ..... *E02F 9/267* (2013.01); *E02F 9/2296* (2013.01)

(58) Field of Classification Search
None
See application file for complete search history.

(56) References Cited

U.S. PATENT DOCUMENTS

2010/0070130 A1 3/2010 Suzuki et al.
2019/0172274 A1* 6/2019 Duan ..... F16H 59/00
2020/0024825 A1* 1/2020 Futakami ..... E02F 3/96

FOREIGN PATENT DOCUMENTS

CN 113503289 A 10/2021
EP 3 043 066 A1 7/2016
(Continued)

OTHER PUBLICATIONS

Machine translation of Mori et al. (JP-2018005738-A) (Year: 2018).*
(Continued)

*Primary Examiner* — Navid Z. Mehdizadeh
*Assistant Examiner* — Sarah A. Mueller
(74) *Attorney, Agent, or Firm* — Crowell & Moring LLP

(57) ABSTRACT

A work machine diagnosis device includes: a display device that displays an operation procedure of a work machine; a controller that acquires a state quantity from a sensor that senses the state quantity of the work machine while the work machine is being operated with the operation procedure, and diagnoses actuation performance of the work machine based on the state quantity; and an output device that outputs a diagnosis result. The controller determines an actuation performance value representing predetermined actuation performance of the work machine and a plurality of causal parameters that influence the actuation performance value; computes a degree of influence of each of the plurality of causal parameters on the actuation performance value based on the plurality of causal parameters, and a reference value preset for each of the causal parameters; and causes the output device to output the actuation performance value and the degrees of influence.

6 Claims, 12 Drawing Sheets

(56) References Cited

FOREIGN PATENT DOCUMENTS

| | | | |
|---|---|---|---|
| JP | 6-74876 | A | 3/1994 |
| JP | 2004-232343 | A | 8/2004 |
| JP | 2005-227141 | A | 8/2005 |
| JP | 2009-180196 | A | 8/2009 |
| JP | 2016-125947 | A | 7/2016 |
| JP | 2018-5738 | A | 1/2018 |
| JP | 2020-166745 | A | 10/2020 |
| KR | 10-2010-0049502 | A | 5/2010 |

OTHER PUBLICATIONS

International Search Report (PCT/ISA/210) issued in PCT Application No. PCT/JP2023/010459 dated May 16, 2023 with English translation (4 pages).
Japanese-language Written Opinion (PCT/ISA/237) issued in PCT Application No. PCT/JP2023/010459 dated May 16, 2023 with English translation (5 pages).
International Preliminary Report on Patentability (PCT/IB/338 & PCT/IB/373) issued in PCT Application No. PCT/JP2023/010459 dated Oct. 10, 2024, including English translation of document C2 (Japanese-language Written Opinion (PCT/ISA/237), filed on Feb. 28, 2024) (5 pages).
Korean-language Office Action issued in Korean Application No. 10-2024-7006559 dated Feb. 11, 2026 with English translation (9 pages).
Extended European Search Report issued in European Application No. 23779701.4 dated Mar. 16, 2026 (9 pages).

* cited by examiner

WORK MACHINE DIAGNOSIS DEVICE

TECHNICAL FIELD

The present invention relates to a work machine diagnosis device.

BACKGROUND ART

A work machine such as a hydraulic excavator has mounted thereon equipment such as an engine or hydraulic equipment. If the work machine is operated for a long term, these pieces of equipment age, and the actuation performance of the work machine deteriorates. For the work machine that performs work such as earth and sand excavation or loading, deterioration of the actuation performance becomes a problem that directly leads to deterioration of the work efficiency. Accordingly, it is desirable if maintenance (inspection, replacement) of the equipment is performed regularly, and the actuation performance is kept at a proper level.

There is a conventionally known construction machine information managing device that causes a display device to display measurement data of a hydraulic excavator obtained by measurement according to a preset measurement method, and factory default data obtained by measurement at the time of shipment (Patent Document 1).

PRIOR ART DOCUMENT

Patent Document

Patent Document 1: JP-2004-232343-A

SUMMARY OF THE INVENTION

Problem to be Solved by the Invention

Recovery of deteriorated actuation performance requires to identify equipment which is a cause of the performance deterioration, and maintenance of the identified equipment. Deterioration of the actuation performance is not necessarily brought about by a single cause. Because of this, identifying a cause of performance deterioration has required a lot of time.

The technology described in Patent Document 1 makes it possible to check deterioration of actuation performance, but does not make it possible to identify causes of the deterioration of the actuation performance. Because of this, there has been a problem that identifying maintenance subject equipment takes time and effort, and the efficiency of maintenance work is low.

An object of the present invention is to provide a work machine diagnosis device that can easily identify maintenance subject equipment, and can enhance the efficiency of maintenance work.

Means for Solving the Problem

A work machine diagnosis device according to an aspect of the present invention includes: a display device that displays an operation procedure of a work machine; a controller that acquires a state quantity from a sensor that senses the state quantity of the work machine while the work machine is being operated in accordance with the operation procedure, and is configured to diagnose actuation performance of the work machine on the basis of the state quantity of the work machine; and an output device that outputs a diagnosis result obtained by the diagnosis by the controller. The controller is configured to: measure, on the basis of a plurality of state quantities sensed by the sensor, an actuation performance value representing predetermined actuation performance of the work machine, and a plurality of causal parameters that influence the actuation performance value; compute a degree of influence of each of the plurality of causal parameters on the actuation performance value on the basis of measurement values of the plurality of causal parameters, and a reference value preset for each of the plurality of causal parameters; and cause the output device to output the actuation performance value and the degrees of influence.

Advantages of the Invention

The present invention can provide a work machine diagnosis device that can easily identify maintenance subject equipment, and can enhance the efficiency of maintenance work.

MODES FOR CARRYING OUT THE INVENTION

With reference to the figures, work machine diagnosis devices according to embodiments of the present invention are explained.

First Embodiment

Figure 1:
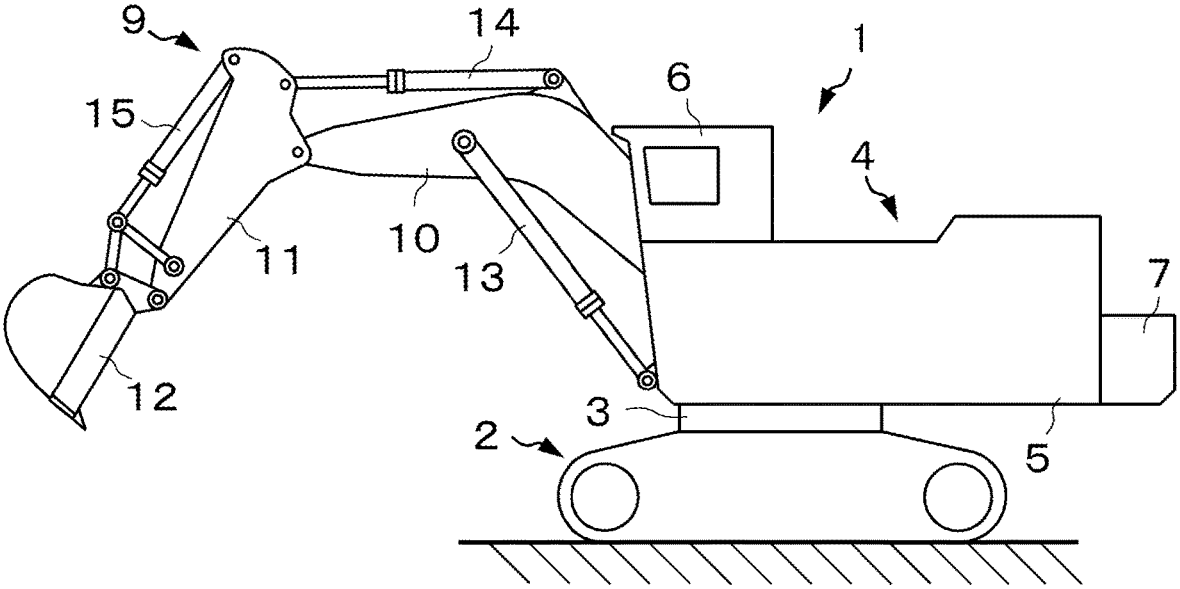
FIG. 1 is a side view of a hydraulic excavator depicted as an example of a work machine.

FIG. 1 is a side view of a hydraulic excavator 1 depicted as an example of a work machine according to the present embodiment. As depicted in FIG. 1, the work machine according to the present embodiment is the hydraulic excavator 1 of backhoe type. The hydraulic excavator 1 includes: a crawler type lower travel structure 2; an upper swing structure 4 swingably attached onto the lower travel structure 2 via a swing device 3; and a front work implement (hereinafter, simply written as a work implement) 9 pivotably attached at a front portion of the upper swing structure 4.

The swing device 3 includes: a swing motor 3A (see FIG. 2), which is a hydraulic actuator that converts hydraulic power into rotational power; a swing speed reduction gear 3B (see FIG. 2) that amplifies the output torque of the swing motor 3A; and a swing bearing (not depicted) that makes a swing smooth while supporting the weight of the upper swing structure 4. The swing motor 3A is rotationally driven by a hydraulic working fluid delivered from a hydraulic pump 22 (see FIG. 2).

The upper swing structure 4 includes: a swing frame 5, which is a support structure; a cab 6 that is arranged at a front portion of the swing frame 5 and in which an operator who operates the hydraulic excavator 1 gets; and a counter weight 7 that is arranged at a rear portion of the swing frame 5, and keeps the overall weight balance of the hydraulic excavator 1. Although not depicted, a swing angle sensor 4A (see FIG. 2) for sensing the swing angle is attached to the upper swing structure 4.

An operator's seat (not depicted) on which an operator is to be seated is provided in the cab 6. An operation device 61 (see FIG. 2) to be operated by the operator for causing the work implement 9, the upper swing structure 4, and the lower travel structure 2 to perform actions is provided near the operator's seat in the cab 6. In addition, a touch panel monitor 62 (see FIG. 2) is provided in the cab 6.

Figure 2:
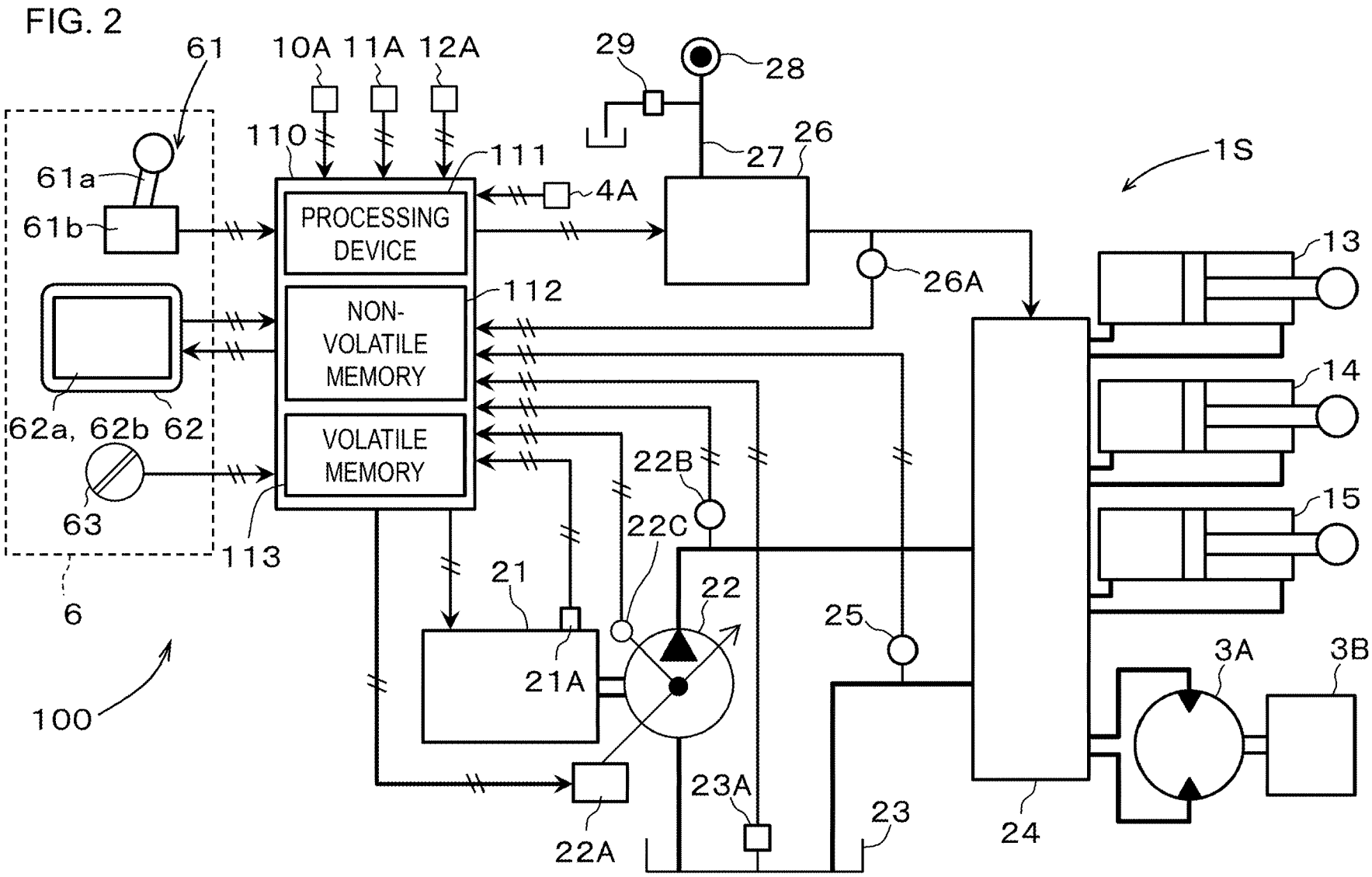
FIG. 2 is a figure depicting a hydraulic system that controls actions of a work implement and an upper swing structure.

As depicted in FIG. 2, the touch panel monitor 62 includes: a display device 62*a* such as a liquid crystal display device; and an input device 62*b* such as a capacitive touch sensor provided on the display screen of the display device 62*a*. The display device 62*a* is an output device that outputs, as images, information representing: operational information of the hydraulic excavator 1; operation procedures of the hydraulic excavator 1 when diagnoses of the hydraulic excavator 1 mentioned later are performed; and diagnosis results of the hydraulic excavator 1 obtained by diagnoses by a controller 110 mentioned later. The input device 62*b* inputs, to the controller 110, a signal according to operation by an operator.

As depicted in FIG. 1, the work implement 9 has: a boom 10 whose base end is pivotably attached to the swing frame 5; an arm 11 pivotably attached to the front end of the boom 10; and a bucket 12 pivotably attached to the front end of the arm 11. A boom angle sensor 10A (see FIG. 2) for sensing the pivot angle of the boom 10 relative to the upper swing structure 4 is attached to the boom 10. An arm angle sensor 11A (see FIG. 2) for sensing the pivot angle of the arm 11 relative to the boom 10 is attached to the arm 11. A bucket angle sensor 12A (see FIG. 2) for sensing the pivot angle of the bucket 12 relative to the arm 11 is attached to the bucket 12.

The work implement 9 includes: a boom cylinder 13 connecting the swing frame 5 and the boom 10; an arm cylinder 14 connecting the boom 10 and the arm 11; and a bucket cylinder 15 connecting the arm 11 and the bucket 12. The boom cylinder 13, the arm cylinder 14, and the bucket cylinder 15 are hydraulic actuators that are driven to extend and retract by the hydraulic working fluid delivered from the hydraulic pump 22 (see FIG. 2). The boom cylinder 13 extends and retracts to cause the boom 10, which is a drive subject member, to pivot. Similarly, the arm cylinder 14 and the bucket cylinder 15 extend and retract to cause the arm 11 and the bucket 12, which are drive subject members, to pivot, respectively. Hereinbelow, the boom cylinder 13, the arm cylinder 14, and the bucket cylinder 15 are collectively referred to as hydraulic cylinders in a case where particular distinctions need not be made therebetween.

FIG. 2 is a figure depicting a hydraulic system 1S that controls actions of the work implement 9 and the upper swing structure 4. With reference to FIG. 2, major constituent elements of the hydraulic system 1S mounted on the hydraulic excavator 1 are explained. As depicted in FIG. 2, the hydraulic system 1S includes: an engine 21, which is a prime mover; the hydraulic pump 22 that is driven by the engine 21, and delivers the hydraulic working fluid; a tank 23 in which the hydraulic working fluid is stored; a control valve 24 that controls flows of the hydraulic working fluid supplied from the hydraulic pump 22 to the hydraulic cylinders 13, 14, and 15 and the swing motor 3A; proportional control valves 26 that control actions of the control valve 24; and the controller 110 that controls the proportional control valves 26.

For example, the engine 21 is a diesel engine including a plurality of cylinders, and rotationally drives the hydraulic pump 22. The engine 21 is provided with an engine speed sensor 21A that senses the revolution speed of the engine 21, and outputs a signal representing sensing results to the controller 110. An engine control dial 63 to be operated by an operator is provided in the cab 6. The engine control dial 63 is connected to the controller 110. The controller 110 sets a target revolution speed of the engine 21 on the basis of the operation amount of the engine control dial 63. The controller 110 controls a fuel injection device of the engine 21 such that the actual engine revolution speed approaches the set target revolution speed.

The hydraulic pump 22 sucks the hydraulic working fluid from the tank 23 by being rotationally driven by the engine 21, and delivers the sucked hydraulic working fluid to a hydraulic line. For example, the hydraulic pump 22 is a swash plate type variable displacement hydraulic pump. That is, the hydraulic pump 22 includes a displacement varying section having a swash plate. The displacement varying section is driven by a regulator 22A. The regulator 22A is electrically connected with the controller 110, and drives the displacement varying section in accordance with a command signal output from the controller 110. When the displacement varying section is driven, and the tilt of the swash plate is changed, the delivery capacity (displacement volume) per rotation of the hydraulic pump 22 changes.

The delivery port of the hydraulic pump 22 is provided with a pressure sensor 22B that senses the delivery pressure of the hydraulic pump 22, and outputs a signal representing sensing results to the controller 110. The tank 23 is provided with a hydraulic working fluid temperature sensor 23A that senses the hydraulic working fluid temperature, and outputs a signal representing sensing results to the controller 110. The displacement varying section is provided with a tilting angle sensor 22C that senses the tilting angle of the swash plate of the hydraulic pump 22, and outputs a signal representing sensing results to the controller 110.

The control valve 24 is provided between the hydraulic pump 22 and the hydraulic actuators 3A, 13, 14, and 15.

Figure 3:
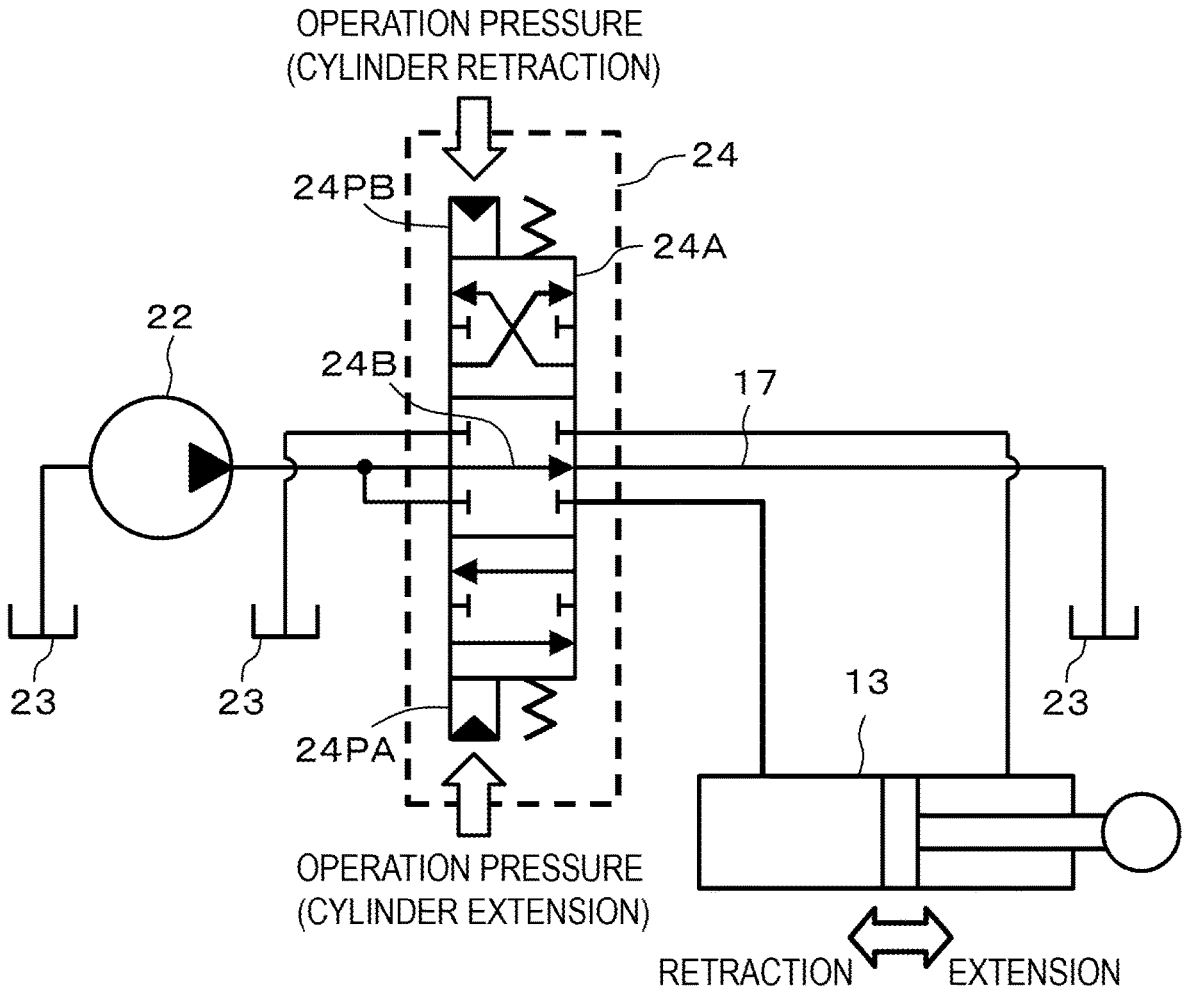
FIG. 3 is a diagram depicting the configuration of a control valve.

With reference to FIG. 3, the configuration of the control valve 24 is explained. FIG. 3 is a diagram depicting the configuration of the control valve 24. As depicted in FIG. 3, the inside of the control valve 24 is provided with a flow control valve 24A for controlling flow rates and directions of the hydraulic working fluid supplied from the hydraulic pump 22 to the hydraulic actuators 3A, 13, 14, and 15.

Note that although only the flow control valve 24A that controls a flow of the hydraulic working fluid supplied to the boom cylinder 13 is depicted in FIG. 3 as an example of hydraulic actuators, actually, the control valve 24 is provided with a plurality of flow control valves 24A that control flows of the hydraulic working fluid supplied to the arm cylinder 14, the bucket cylinder 15, and the swing motor 3A.

Both ends of the spool of the flow control valve 24A are provided with pilot pressure receiving sections 24PA and 24PB. In a state where a tank pressure is acting on each of the pilot pressure receiving sections 24PA and 24PB, the flow control valve 24A is positioned at the neutral position. Operation pressures generated by the proportional control valves 26 (see FIG. 2) are introduced to the pilot pressure receiving sections 24PA and 24PB. The movement amount of the spool of the flow control valve 24A is controlled by the operation pressures, and the movement of the spool of the flow control valve 24A controls the supply flow rate and direction of the hydraulic working fluid supplied to a hydraulic actuator (the boom cylinder 13 in FIG. 3).

The flow control valve 24A is provided on a center bypass line 17 connecting the hydraulic pump 22 and the tank 23. The flow control valve 24A has: a bleed-off passage section 24B that introduces the hydraulic working fluid delivered from the hydraulic pump 22 to the tank 23 when the flow control valve 24A is at the neutral position, a meter-in passage section that introduces the hydraulic working fluid supplied from the hydraulic pump 22 to the boom cylinder 13; and a meter-out passage section that introduces the hydraulic working fluid supplied from the boom cylinder 13 (return fluid) to the tank 23.

The flow control valve 24A controls the flow rate of the hydraulic working fluid supplied to the boom cylinder 13 according to a displacement amount (spool stroke) from the neutral position. As the displacement amount of the flow control valve 24A from the neutral position increases, the speed of the boom cylinder 13 increases. The displacement amount from the neutral position increases according to an increase in the operation amount of the operation device 61 mentioned later. That is, the flow control valve 24A controls the supply flow rate of the hydraulic working fluid supplied to the boom cylinder 13 according to the operation amount of the operation device 61. In addition, when the flow control valve 24A moves in one direction from the neutral position, the boom cylinder 13 extends, and when the flow control valve 24A moves in the other direction from the neutral position, the boom cylinder 13 retracts. That is, the flow control valve 24A controls the drive direction and speed of the boom cylinder 13.

the operation device 61 depicted in FIG. 2 has: operation levers for operating the respective hydraulic actuators 13 to 15, and 3A; and operation amount sensors that sense the operation amounts of the respective operation levers. Note that, for simplification of explanations, configuration for driving the boom cylinder 13 is explained representatively with reference to FIG. 2. The operation device 61 has: an operation lever 61*a*, which is an operation member used to operate the boom 10 (the boom cylinder 13, the flow control valve 24A); and an operation amount sensor 61*b* that senses the operation amount of the operation lever 61*a*, and outputs, to the controller 110, a signal representing sensing results. Note that, although not depicted, the operation device 61 has an arm operation lever for operating the arm 11, a bucket operation lever for operating the bucket 12, and a swing operation lever for operating the upper swing structure 4.

The controller 110 outputs, to a proportional control valve 26, a command signal according to the operation direction and operation amount of the operation lever 61*a* sensed by the operation amount sensor 61*b*. When the command signal is input from the controller 110, the proportional control valve 26 reduces the pressure (primary pressure) of a pilot line 27 connected to a pilot hydraulic fluid source (e.g. a pilot pump) 28, and generates an operation pressure (secondary pressure) according to the operation amount of the operation lever 61*a*. Note that the pressure of the pilot line 27 is regulated by a pilot relief valve 29. The proportional control valve 26 outputs the generated operation pressure to a pilot pressure receiving section of the flow control valve 24A corresponding to the operation direction of the operation lever 61*a*. For example, the operation lever 61*a* is provided to the right of the operator's seat, and is operated in the front-back direction. When the operation lever 61*a* is operated backward, the boom 10 is caused to perform an action in the raising direction. When the operation lever 61*a* is operated forward, the boom 10 is caused to perform an action in the lowering direction.

A proportional control valve 26 supplies, to the flow control valve 24A of the control valve 24, an operation pressure proportional to a command signal output from the controller 110, and controls the movement amount of the flow control valve 24A. A proportional control valve 26 is provided for each pilot pressure receiving section of the spool of the control valve 24. For example, as the proportional control valves 26, there are a boom raising proportional control valve 26 that outputs an operation pressure to the pilot pressure receiving section 24PA of the boom cylinder 13, and a boom lowering proportional control valve 26 that outputs an operation pressure to the pilot pressure receiving section 24PB of the boom cylinder 13.

As depicted in FIG. 3, when the operation pressure output from the boom raising proportional control valve 26 is introduced to the pilot pressure receiving section 24PA of the flow control valve 24A via a pilot hydraulic line, the spool of the flow control valve 24A is driven in the upward direction in the figure. Thus, the hydraulic working fluid delivered from the hydraulic pump 22 is supplied to the bottom side fluid chamber of the boom cylinder 13 through the meter-in passage section of the flow control valve 24A, and the hydraulic working fluid in the rod side fluid chamber is discharged to the tank 23 through the meter-out passage section of the flow control valve 24A. As a result, the boom cylinder 13 extends, and the boom 10 is caused to perform an action in the raising direction.

When the operation pressure output from the boom lowering proportional control valve 26 is introduced to the pilot pressure receiving section 24PB of the flow control valve 24A via a pilot hydraulic line, the spool of the flow control valve 24A is driven in the downward direction in the figure. Thus, the hydraulic working fluid delivered from the hydraulic pump 22 is supplied to the rod side fluid chamber of the boom cylinder 13 through the meter-in passage section of the flow control valve 24A, and the hydraulic working fluid in the bottom side fluid chamber is discharged to the tank 23 through the meter-out passage section of the flow control valve 24A. As a result, the boom cylinder 13 retracts, and the boom 10 is caused to perform an action in the lowering direction.

As depicted in FIG. 2, the pilot hydraulic line connecting a proportional control valve 26 and the control valve 24 is provided with a pressure sensor 26A that senses an operation pressure generated by the proportional control valve 26, and outputs sensing results to the controller 110.

A return fluid line connecting the control valve 24 and the tank 23 is provided with a pressure sensor 25 that senses the pressure of the hydraulic working fluid flowing from the control valve 24 to the tank 23, and outputs a signal representing sensing results to the controller 110.

The controller 110 is configured by using a computer including: a processing device 111 such as a CPU (Central Processing Unit), an MPU (Micro Processing Unit), or a DSP (Digital Signal Processor); a non-volatile memory 112 such as a ROM (Read Only Memory), a flash memory, or a hard disk drive; a volatile memory 113 which is a commonly called RAM (Random Access Memory); an input/output interface; and other peripheral circuits. These pieces of hardware cooperate with each other to operate software, and realize a plurality of functions. Note that the controller 110 may be configured by using one computer or may be configured by using a plurality of computers.

The non-volatile memory 112 has stored thereon programs that can execute various types of computation. That is, the non-volatile memory 112 is a storage medium from which a program that realizes functions of the present embodiment can be read out. The processing device 111 is a device that loads a program stored on the non-volatile memory 112 onto the volatile memory 113, and executes computation. The processing device 111 performs a predetermined computation process on data taken in from the input/output interface, the non-volatile memory 112, and the volatile memory 113 in accordance with the program.

The controller 110 is connected to each of the angle sensors 4A, 10A, 11A, and 12A, the engine speed sensor 21A, the pressure sensors 22B, 25, and 26A, the tilting angle sensor 22C, the hydraulic working fluid temperature sensor 23A, the operation amount sensor 61*b* of the operation device 61, the touch panel monitor 62, the engine control dial 63, and the proportional control valves 26.

An input section of the input/output interface converts signals input from the sensors (4A, 10A, 11A, 12A, 21A, 22B, 25, 26A, 22C, 23A, and 61*b*) or the like into data on which computation can be performed at the processing device 111. In addition, an output section of the input/output interface generates a signal to be output according to results of the computation at the processing device 111, and outputs the signal to various types of device (the proportional control valves 26, the regulator 22A, the display device 62*a*) or the like.

The controller 110 controls the hydraulic system 1S by controlling the hydraulic pump 22 and the proportional control valves 26. In addition, the controller 110 diagnoses the actuation performance of the hydraulic excavator 1 on the basis of a plurality of state quantities of the hydraulic excavator 1 sensed by the sensors (4A, 10A, 11A, 12A, 21A, 22B, 22C, 23A, 25, and 26A) (the swing angle, the boom angle, the arm angle, the bucket angle, the revolution speed of the engine 21, the delivery pressure of the hydraulic pump 22, the tilting angle of the swash plate of the hydraulic pump 22, the hydraulic working fluid temperature, the pressure of the hydraulic working fluid flowing from the control valve 24 to the tank 23, and the operation pressures generated by the proportional control valves 26).

The delivery pressure of the hydraulic pump 22 sensed by the pressure sensor 22B is equivalent to the upstream side pressure of the bleed-off passage section 24B of the flow control valve 24A on the center bypass line 17. In addition, the pressure of the hydraulic working fluid discharged from the control valve 24 to the tank 23 sensed by the pressure sensor 25 is equivalent to the downstream side pressure of the bleed-off passage section 24B of the flow control valve 24A on the center bypass line 17.

The controller 110 computes the differential pressure (pressure loss) $\Delta Pb$ across the bleed-off passage section 24B of the flow control valve 24A of the control valve 24 on the basis of a pressure P1 sensed by the pressure sensor 22B and a pressure P2 sensed by the pressure sensor 25 ($\Delta Pb = P1 - P2$).

The controller 110 controls the delivery capacity (volume) of the hydraulic pump 22 on the basis of the operation amount of the operation lever 61*a* sensed by the operation amount sensor 61*b* of the operation device 61 or the like. By causing the hydraulic working fluid delivered from the hydraulic pump 22 to be supplied to the hydraulic actuators 3A, 13, 14, and 15, the hydraulic actuators 3A, 13, 14, and 15 are caused to perform actions, and drive subject members are caused to perform actions.

The actuation speeds which are one type of physical quantity representing the actuation performance of the hydraulic actuators 3A, 13, 14, and 15 are determined by the flow rate of the hydraulic working fluid delivered from the hydraulic pump 22 (hereinafter, written also as the delivery flow rate of the hydraulic pump 22), the leakage flow rate of the hydraulic working fluid, and the bleed-off flow rate. Note that the delivery flow rate of the hydraulic pump 22 is determined by the rotation speed of the hydraulic pump 22 and the delivery capacity of the hydraulic pump 22. When at least either of the rotation speed and delivery capacity of the hydraulic pump 22 decreases, the delivery flow rate of the hydraulic pump 22 decreases also.

The leakage of the hydraulic working fluid is a flow rate loss that is generated on each piece of hydraulic equipment such as the hydraulic pump 22, the control valve 24, or the hydraulic actuators 3A, 13, 14, or 15, hydraulic lines connecting the hydraulic equipment, or the like, when the hydraulic working fluid is supplied from the hydraulic pump 22 to the hydraulic actuators 3A, 13, 14, and 15.

The bleed-off flow rate is the flow rate of the hydraulic working fluid that is delivered from the hydraulic pump 22, and recirculated through the bleed-off passage section 24B of the control valve 24 and the center bypass line 17 to the tank 23. For example, as a proportional control valve 26 ages, the operation pressure generated by the proportional control valve 26 decreases relative to a target operation pressure according to a command signal of the controller 110. If the actual operation pressure decreases relative to the target operation pressure, the movement amount of the flow control valve 24A when the operation lever 61*a* is operated decreases. As a result, the bleed-off flow rate increases, and the supply flow rates of the hydraulic working fluid supplied to the hydraulic actuators 3A, 13, 14, and 15 decrease.

As mentioned above, an actuation performance value (e.g. the actuation speed of a hydraulic actuator) which is a physical quantity representing the actuation performance of the hydraulic excavator 1 is determined by a plurality of causal parameters (e.g. the rotation speed of the hydraulic pump 22, the delivery capacity of the hydraulic pump 22, the leakage flow rate of the hydraulic working fluid, and the bleed-off flow rate). Note that the actuation speed of the boom cylinder 13 can be evaluated by the actuation duration required for causing the boom cylinder 13 to perform an action until its length changes by a predetermined length. That is, the actuation duration of the boom cylinder 13 can be said to be one of actuation performance values of the hydraulic excavator 1.

Here, if causal parameters with high degrees of contribution to reduction of physical quantities representing the actuation performance of the hydraulic excavator 1 in the plurality of causal parameters, that is, causal parameters with significant degrees of influence on the actuation performance values, can be known, an operator can easily identify equipment on which maintenance should be performed.

In view of this, the controller 110 according to the present embodiment acquires sensor values (sensing values) sensed by the sensors (4A, 10A, 11A, 12A, 21A, 22B, 22C, 23A, 25, and 26A) that are provided to the hydraulic excavator 1, and sense various state quantities of the hydraulic excavator 1 when the hydraulic excavator 1 is being moved in accordance with an operation procedure of the hydraulic excavator 1, and measures a plurality of causal parameters that influence the actuation performance values on the basis of the acquired sensor values (sensed state quantities). Furthermore, the controller 110 computes the degree of influence of each of the plurality of causal parameters on a actuation performance value on the basis of measurement values of the plurality of causal parameters, and a reference value preset for each of the plurality of causal parameters, and causes the touch panel monitor 62 to output the actuation performance values and the degrees of influence.

Hereinbelow, details of functions of the controller 110 of a diagnosis device 100 that executes a diagnosis process on the hydraulic excavator 1 are explained. The diagnosis device 100 includes: the display device 62*a* that displays an operation procedure of the hydraulic excavator 1 when a diagnosis of the hydraulic excavator 1 is performed; the input device 62*b* operated by an operator for proceeding with the diagnosis; and the controller 110 that measures actuation performance values on the basis of sensor values sensed by the plurality of sensors (4A, 10A, 11A, 12A, 21A, 22B, 22C, 23A, 25, and 26A), and causes the display device 62*a* as an output device to output diagnosis results including the measured actuation performance values.

Figure 4:
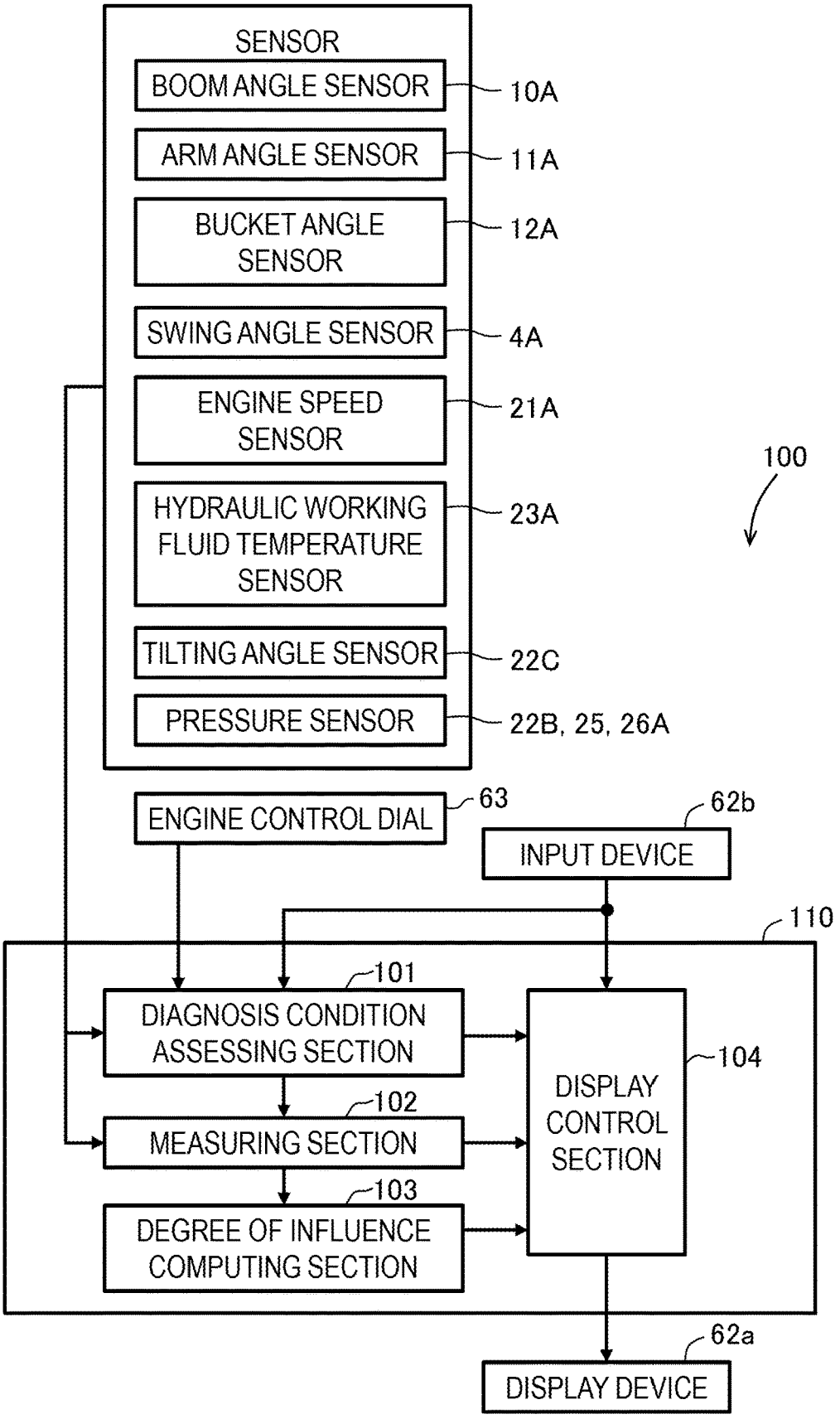
FIG. 4 is a functional block diagram of a controller of a diagnosis device according to a first embodiment.

FIG. 4 is a functional block diagram of the controller 110 of the diagnosis device 100. By executing a program stored on the non-volatile memory 112, the controller 110 functions as a diagnosis condition assessing section 101, a measuring section 102, a degree of influence computing section 103, and a display control section 104.

The display control section 104 controls the display device 62*a* to cause the display screen of the display device 62*a* to display an operation procedure of the hydraulic excavator 1. Thus, an operator can proceed with a diagnosis of the hydraulic excavator 1 while checking the display device 62*a*.

The diagnosis condition assessing section 101 assesses whether or not a diagnosis start condition is satisfied. The diagnosis start condition is as follows.

Diagnosis start condition: The work implement 9 is at a diagnosis start posture, the hydraulic working fluid temperature is within a target range, and the operation amount of the engine control dial 63 is within a target range.

Note that the diagnosis condition assessing section 101 assesses that the work implement 9 is at the diagnosis start posture in a case where the boom angle α sensed by the boom angle sensor 10A is within a preset boom target range, the arm angle β sensed by the arm angle sensor 11A is within a preset arm target range, and the bucket angle γ sensed by the bucket angle sensor 12A is within a preset bucket target range.

The diagnosis condition assessing section 101 assesses that the diagnosis start condition is not satisfied in a case where at least one of the boom angle α, the arm angle β, the bucket angle γ, the hydraulic working fluid temperature, and the operation amount of the engine control dial 63 is not within the target range.

When diagnosis start operation by an operator is performed in a case where the diagnosis start condition is satisfied, the measuring section 102 measures a plurality of causal parameters within a predetermined measurement range.

The measuring section 102 measures, as one of the actuation performance values of the hydraulic excavator 1, the duration (hereinafter, written also as actuation duration of the boom cylinder 13) T required for the boom cylinder 13 to perform an action until its length changes by a predetermined length u when the operation lever 61*a* is operated at full stroke, and the boom cylinder 13 is actuated singly. The actuation duration T is measured by an internal clock (timer function) of the controller 110.

Note that, similarly to the actuation duration of the boom cylinder 13, the measuring section 102 measures, as actuation performance values, the actuation duration of the arm cylinder 14 and bucket cylinder 15. In addition, the measuring section 102 measures, as one of the actuation performance values of the hydraulic excavator 1, the duration (hereinafter, written also as the actuation duration of the swing motor 3A) T required for the swing motor 3A to rotate by a predetermined rotation angle (rotation speed) when the swing operation lever of the operation device 61 is operated at full stroke, and the swing motor 3A is actuated singly.

As mentioned above, the actuation duration of a hydraulic actuator is duration required to cause the hydraulic actuator to perform an action until a preset predetermined displacement (a stroke length or a rotation angle) is attained. Because of this, the actuation duration of the hydraulic actuator can also be said to be a parameter representing an actuation speed. In addition, instead of actuation duration, the measuring section 102 may compute, as an actuation performance value, the actuation speed of the hydraulic actuator on the basis of a predetermined displacement and actuation duration.

The measuring section 102 measures, as the actuation duration T of the boom cylinder 13, the duration until the boom angle α changes from a measurement start angle α1 to a measurement end angle α2. When the boom 10 pivots from the measurement start angle α1 to the measurement end angle α2, the length of the boom cylinder 13 changes by the predetermined length u. The measurement range from the measurement start angle α1 to the measurement end angle α2 is preset within the movable range of the boom 10. The measurement start angle α1 and the measurement end angle α2 are preset, and stored on the non-volatile memory 112.

A method of calculating a plurality of causal parameters that influence the actuation duration T of the boom cylinder 13, and a method of calculating the degrees of influence of the plurality of causes on the actuation duration T of the boom cylinder 13 are explained.

The plurality of causal parameters that influence the actuation duration T (actuation speed) of the boom cylinder 13 include the rotation speed of the hydraulic pump 22, the delivery capacity of the hydraulic pump 22, the leakage flow rate of the hydraulic working fluid, and the bleed-off flow rate. The actuation duration T of the boom cylinder 13 is represented by Formula (1) below.

[Math. 1]

$$T = \frac{Q_a}{N \cdot q - Q_l - Q_b} = \frac{A \cdot u}{N \cdot q - Q_l - Q_b} \quad (1)$$

In Formula (1), Qa is a volume change of the boom cylinder 13 that is generated while the length of the boom cylinder 13 changes by u, that is, a volume change amount of the boom cylinder 13. That is, Qa is equivalent to an amount (volume) of the hydraulic working fluid having flowed into the boom cylinder 13 in the actuation duration T of the boom cylinder 13 (from the measurement start time until the measurement end time). The amount (hereinafter, written also as the hydraulic working fluid inflow amount) Qa of the hydraulic working fluid flowing into the boom cylinder 13 is determined by multiplying the cross sectional area A of the boom cylinder 13 and the stroke displacement u of the boom cylinder 13 (Qa=A·u). Note that in a case where two boom cylinders 13 are provided to the hydraulic excavator 1, A is the total cross sectional area of the two boom cylinders 13.

N is the average rotation speed of the hydraulic pump 22 while the length of the boom cylinder 13 changes by u, and q is the average delivery capacity (average pump displacement) of the hydraulic pump 22 while the length of the boom cylinder 13 changes by u. Ql is the average leakage flow rate of the hydraulic working fluid while the length of the boom cylinder 13 changes by u, and Qb is the average bleed-off flow rate while the length of the boom cylinder 13 changes by u.

As can be known also from Formula (1), an increase in the actuation duration T (a decrease in the actuation speed) of the boom cylinder 13 is generated by a decrease in the rotation speed of the hydraulic pump 22, a decrease in the delivery capacity of the hydraulic pump 22, an increase in the leakage flow rate of the hydraulic working fluid, and an increase in the bleed-off flow rate.

The non-volatile memory 112 of the controller 110 has stored thereon a reference value Nn of the rotation speed of the hydraulic pump 22, a reference value qn of the delivery capacity of the hydraulic pump 22, a reference value Qln of the leakage flow rate of the hydraulic working fluid, and a reference value Qbn of the bleed-off flow rate. These reference values (initial values) Nn, qn, Qln, and Qbn are values that are measured at the time of shipment, or values determined on the basis of design specifications of respective pieces of equipment related to the actuation of the boom cylinder 13. Note that, in the present embodiment, the reference value Qbn of the bleed-off flow rate at the time of full stroke operation of the operation lever 61*a* is 0 (zero).

The measuring section 102 computes reference actuation duration TO which is the actuation duration of the boom cylinder 13 supposing that all of the plurality of causal parameters are the reference values Nn, qn, Qln, and Qbn. The reference actuation duration TO is determined by replacing N, q, Ql, and Qb in Formula (1) with the reference values Nn, qn, Qln, and Qbn.

The degree of influence computing section 103 computes actuation duration Tns of the boom cylinder 13 supposing that only the rotation speed of the hydraulic pump 22 in the plurality of causal parameters is a measurement value N measured on the basis of a sensor value (a sensing result of the engine speed sensor 21A), and other causal parameters in the plurality of causal parameters than the rotation speed of the hydraulic pump 22 are the reference values qn, Qln, and Qbn. The actuation duration Tns is determined by replacing the measurement values q, Ql, and Qb in Formula (1) with the reference values qn, Qln, and Qbn.

The degree of influence computing section 103 computes a temporal difference ΔT(N) between the actuation duration Tns and the reference actuation duration T0 by subtracting the reference actuation duration T0 from the actuation duration Tns. That is, the degree of influence computing section 103 computes the temporal difference ΔT(N) in accordance with Formula (2) below.

[Math. 2]

$$\Delta T(N) = Q_a\left(\frac{1}{N \cdot q_n - Q_{ln} - Q_{bn}} - \frac{1}{N_n \cdot q_n - Q_{ln} - Q_{bn}}\right) \quad (2)$$

The temporal difference ΔT(N) computed by the degree of influence computing section 103 is equivalent to an increase amount of the actuation duration (a decrease amount of the actuation performance value) supposing that only the rotation speed of the hydraulic pump 22 in the plurality of causal parameters decreased from the reference value (initial value) Nn to the measurement value N.

Note that the measuring section 102 computes a rotation speed N of the hydraulic pump 22 on the basis of the revolution speed of the engine 21 sensed by the engine speed sensor 21A. In a case where the engine 21 and the hydraulic pump 22 are directly coupled, the rotation speed N of the hydraulic pump 22 is equal to the revolution speed of the engine 21. In a case where the engine 21 and the hydraulic pump 22 are coupled via a transmission (not depicted), the rotation speed N of the hydraulic pump 22 is equal to the revolution speed of the engine 21 multiplied by the speed reduction ratio of the transmission.

The degree of influence computing section 103 computes actuation duration Tqs of the boom cylinder 13 supposing that only the delivery capacity of the hydraulic pump 22 in the plurality of causal parameters is the measurement value q measured on the basis of a sensor value (a sensing result of the tilting angle sensor 22C), and other causal parameters in the plurality of causal parameters than the delivery capacity of the hydraulic pump 22 are the reference values Nn, Qln, and Qbn. The actuation duration Tqs is determined by replacing the measurement values N, Ql, and Qb in Formula (1) with the reference values Nn, Qln, and Qbn.

The degree of influence computing section 103 computes the temporal difference ΔT(q) between the actuation duration Tqs and the reference actuation duration T0 by subtracting the reference actuation duration T0 from the actuation duration Tqs. That is, the degree of influence computing section 103 computes the temporal difference ΔT(q) in accordance with Formula (3) below.

[Math. 3]

$$\Delta T(q) = Q_a\left(\frac{1}{N \cdot q_n - Q_{ln} - Q_{bn}} - \frac{1}{N_n \cdot q_n - Q_{ln} - Q_{bn}}\right) \quad (3)$$

The temporal difference ΔT(q) computed by the degree of influence computing section 103 is equivalent to an increase amount of the actuation duration (a decrease amount of the actuation performance value) supposing that only the delivery capacity of the hydraulic pump 22 in the plurality of causal parameters decreased from the reference value (initial value) qn to the measurement value q.

Note that the degree of influence computing section 103 computes a delivery capacity q per rotation of the hydraulic pump 22 on the basis of a tilting angle sensed by the tilting angle sensor 22C, and specifications (the number of pistons, the piston diameter, the cylinder pitch circle diameter, etc.) of the hydraulic pump 22 which is a swash plate type piston pump.

The degree of influence computing section 103 computes actuation duration Tls of the boom cylinder 13 supposing that only the leakage flow rate of the hydraulic working fluid in the plurality of causal parameters is a measurement value Ql measured on the basis of sensor values (sensing results of the engine speed sensor 21A, tilting angle sensor 22C, and boom angle sensor 10A), and other causal parameters in the plurality of causal parameters than the leakage flow rate of the hydraulic working fluid are the reference values Nn, qn, and Qbn. The actuation duration Tls is determined by replacing the measurement values N, q, and Qb in Formula (1) with the reference values Nn, qn, and Qbn.

The degree of influence computing section 103 computes the temporal difference ΔT(Ql) between the actuation duration Tls and the reference actuation duration T0 by subtracting the reference actuation duration T0 from the actuation duration Tls. That is, the degree of influence computing section 103 computes the temporal difference ΔT(Ql) in accordance with Formula (4) below.

[Math. 4]

$$\Delta T(Q_l) = Q_a\left(\frac{1}{N_n \cdot q_n - Q_l - Q_{bn}} - \frac{1}{N_n \cdot q_n - Q_{ln} - Q_{bn}}\right) \quad (4)$$

The temporal difference ΔT(Ql) computed by the degree of influence computing section 103 is equivalent to an increase amount of the actuation duration (a decrease amount of the actuation performance value) supposing that only the leakage flow rate of the hydraulic working fluid in the plurality of causal parameters increased from the reference value (initial value) Qln to the measurement value Ql.

Note that the measuring section 102 computes a leakage flow rate Ql of the hydraulic working fluid by subtracting the flow rate of the hydraulic working fluid supplied to the boom cylinder 13 (hereinafter, written also as the supply flow rate of the hydraulic working fluid supplied to the boom cylinder 13) and a bleed-off flow rate Qb mentioned later from the delivery flow rate of the hydraulic pump 22. The measuring section 102 computes the delivery flow rate of the hydraulic pump 22 by multiplying the delivery capacity q of the hydraulic pump 22 by the rotation speed N of the hydraulic pump 22. The measuring section 102 computes the supply flow rate of the hydraulic working fluid supplied to the boom cylinder 13 by multiplying the cross sectional area A of the boom cylinder 13 by the cylinder speed of the boom cylinder 13. The measuring section 102 computes the stroke displacement of the boom cylinder 13 on the basis of the boom angle sensed by the boom angle sensor 10A. The measuring section 102 compute the cylinder speed of the boom cylinder 13 by obtaining a time derivative of the stroke displacement of the boom cylinder 13.

The degree of influence computing section 103 computes actuation duration Tbs of the boom cylinder 13 supposing that only the bleed-off flow rate in the plurality of causal parameters is a measurement value Qb measured on the basis of sensor values (sensing results of the pressure sensors 22B, 25, and 26A), and other causal parameters in the plurality of causal parameters than the bleed-off flow rate are the reference values Nn, qn, and Qln. The actuation duration Tbs is determined by replacing the measurement values N, q, and Ql in Formula (1) with the reference values Nn, qn, and Qln.

The degree of influence computing section 103 computes the temporal difference ΔT(Qb) between the actuation duration Tbs and the reference actuation duration T0 by subtracting the reference actuation duration T0 from the actuation duration Tbs. That is, the degree of influence computing section 103 computes the temporal difference ΔT(Qb) in accordance with Formula (5) below.

[Math. 5]

$$\Delta T(Q_b) = Q_a\left(\frac{1}{N_n \cdot q_n - Q_{ln} - Q_b} - \frac{1}{N_n \cdot q_n - Q_{ln} - Q_{bn}}\right) \quad (5)$$

The temporal difference ΔT(Qb) computed by the degree of influence computing section 103 is equivalent to an increase amount of the actuation duration (a decrease amount of the actuation performance value) supposing that only the bleed-off flow rate in the plurality of causal parameters increased from the reference value (initial value) Qbn to the measurement value Qb.

Figure 5:
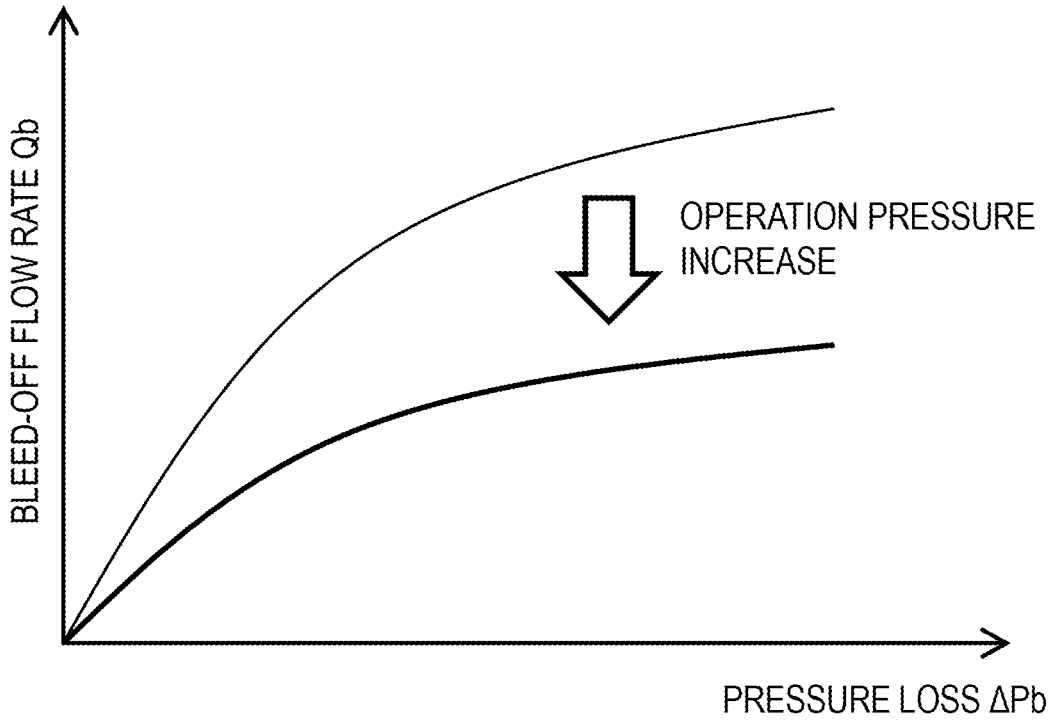
FIG. 5 is a figure depicting a bleed-off flow rate table.

The measuring section 102 computes the bleed-off flow rate Qb on the basis of an operation pressure sensed by the pressure sensor 26A, and the pressure loss ΔPb across the boom flow control valve 24A of the control valve 24. The non-volatile memory 112 has stored thereon a bleed-off flow rate table used for the computation of the bleed-off flow rate. FIG. 5 is a figure depicting the bleed-off flow rate table. As depicted in FIG. 5, the bleed-off flow rate table has stored thereon a plurality of bleed-off flow rate curves (flow rate characteristics) representing bleed-off flow rates that increase and decrease corresponding to increases and decreases in an operation pressure. The bleed-off flow rate table is set such that as the operation pressure increases, the bleed-off flow rate Ob decreases, and as the pressure loss ΔPb of the flow control valve 24A increases, the bleed-off flow rate Qb increases.

The measuring section 102 selects a bleed-off flow rate curve corresponding to the magnitude of the operation pressure, and, with reference to the selected bleed-off flow rate curve, computes the bleed-off flow rate Qb on the basis of the pressure loss ΔPb.

The degree of influence computing section 103 depicted in FIG. 4 computes a degree of influence Z of each of the plurality of causal parameters on a reduction of the actuation speed of the cylinder of the boom cylinder 13. The degrees of influence Z are dimensionless numbers.

The degree of influence computing section 103 computes the sum total ATs of the temporal differences ΔT(N), ΔT(q), ΔT(Ql), and ΔT(Qb) computed using Formulae (2) to (5) (ΔTs=ΔT(N)+ΔT(q)+ΔT(Ql)+ΔT(Qb)).

The degree of influence computing section 103 computes a degree of influence Z(N) of the rotation speed of the hydraulic pump 22 on the actuation duration T of the boom cylinder 13 in accordance with Formula (6) below.

[Math. 6]

$$Z(N) = \frac{\Delta T(N)}{\Delta T_s} \tag{6}$$

The degree of influence computing section 103 computes a degree of influence Z(q) of the delivery capacity of the hydraulic pump 22 on the actuation duration of the boom cylinder 13 in accordance with Formula (7) below.

[Math. 7]

$$Z(q) = \frac{\Delta T(q)}{\Delta T_s} \tag{7}$$

The degree of influence computing section 103 computes a degree of influence Z(Ql) of the leakage flow rate of the hydraulic working fluid on the actuation duration of the boom cylinder 13 in accordance with Formula (8) below.

[Math. 8]

$$Z(Q_l) = \frac{\Delta T(Q_l)}{\Delta T_s} \tag{8}$$

The degree of influence computing section 103 computes a degree of influence Z(Qb) of the bleed-off flow rate on the actuation duration of the boom cylinder 13 in accordance with Formula (9) below.

[Math. 9]

$$Z(Q_b) = \frac{\Delta T(Q_b)}{\Delta T_s} \tag{9}$$

The degree of influence computing section 103 computes the degree of influence of each of the plurality of causal parameters on the actuation duration (actuation speeds) of the arm cylinder 14 and bucket cylinder 15 similarly to the degree of influence of each of the plurality of causal parameters on the actuation duration (actuation speed) of the boom cylinder 13.

In addition, the degree of influence computing section 103 computes the degree of influence of each of the plurality of causal parameters on the actuation duration (actuation speed) of the swing motor 3A. The method of calculating the degrees of influence of the causal parameters on the actuation duration of the swing motor 3A is similar to the method of calculating the degrees of influence of the causal parameters on the actuation duration (actuation speeds) of the hydraulic cylinders.

The plurality of causal parameters that influence the actuation duration T (actuation speed) of the swing motor 3A include the rotation speed of the hydraulic pump 22, the delivery capacity of the hydraulic pump 22, the leakage flow rate of the hydraulic working fluid, and the bleed-off flow rate. The actuation duration T of the swing motor 3A is duration required for the upper swing structure 4 to rotate by a predetermined swing angle θ, and is represented by Formula (10) below.

[Math. 10]

$$T = \frac{Q_a}{N * q - Q_l - Q_b} = \frac{q_m * \theta}{r(N * q - Q_l - Q_b)} \tag{10}$$

Note that, in Formula (10), Qa is a hydraulic working fluid inflow amount which is the amount (volume) of the hydraulic working fluid having flowed into the swing motor 3A while the upper swing structure 4 rotates by the predetermined swing angle θ, that is, in the actuation duration of the swing motor 3A. Qa is determined by multiplying the rotation speed of the swing motor 3A by the volume qm of the swing motor 3A. Here, the rotation speed of the swing motor 3A is determined by dividing the swing angle of the upper swing structure 4 by a swing speed reduction ratio r. Note that the swing speed reduction ratio r is a rotation speed ratio of the upper swing structure 4 relative to the swing motor 3A (swing speed reduction ratio r=(swing speed of upper swing structure)/(rotation speed of swing motor)).

The rotation speed of the hydraulic pump 22, the delivery capacity of the hydraulic pump 22, and the bleed-off flow rate are measured with methods which are the same as those for the causal parameters used for the computation of the actuation duration of the hydraulic cylinders. The measuring section 102 computes the leakage flow rate Ql of the hydraulic working fluid by subtracting the flow rate of the hydraulic working fluid supplied to the swing motor 3A (hereinafter, written also as the supply flow rate of the hydraulic working fluid supplied to the swing motor 3A) and the bleed-off flow rate Qb from the delivery flow rate of the hydraulic pump 22. The measuring section 102 computes the supply flow rate of the hydraulic working fluid supplied to the swing motor 3A by multiplying the volume qm of the swing motor 3A by the rotation speed of the swing motor 3A.

The degree of influence computing section 103 computes the temporal differences ΔT(N), ΔT(q), ΔT(Ql), and ΔT(Qb) using Formulae (2) to (5), and computes the degrees of influence Z(N), Z(q), Z(Ql), and Z(Qb) on the actuation duration (actuation speed) of the upper swing structure 4 using Formulae (6) to (9). Note that, as mentioned above, Qa in Formulae (2) to (5) is a hydraulic working fluid inflow amount which is the amount of the hydraulic working fluid flowing into the swing motor 3A while the upper swing structure 4 rotates by the predetermined swing angle θ (Qa=(qm·θ)/r).

On the basis of a signal input from the input device 62*b*, the display control section 104 causes the display device 62*a* to sequentially display: a diagnosis subject selection screen 161 (see FIG. 7) on which a diagnosis subject is selected; a diagnosis preparation screen 162 (see FIG. 8) for prompting to perform preparation operation for a diagnosis; and an operation instruction screen 163 (see FIG. 9) for giving an instruction to perform operation of hydraulic actuators necessary for the diagnosis. The diagnosis subject selection screen 161, the diagnosis preparation screen 162, and the operation instruction screen 163 are screens representing operation procedures to be performed when a diagnosis of the hydraulic excavator 1 is performed. When the computation of a plurality of the degrees of influence Z by the degree of influence computing section 103 is completed, the display control section 104 causes a diagnosis result screen 164 (see FIG. 10) which is a screen representing diagnosis results of the hydraulic excavator 1 to be displayed.

Figure 6A:
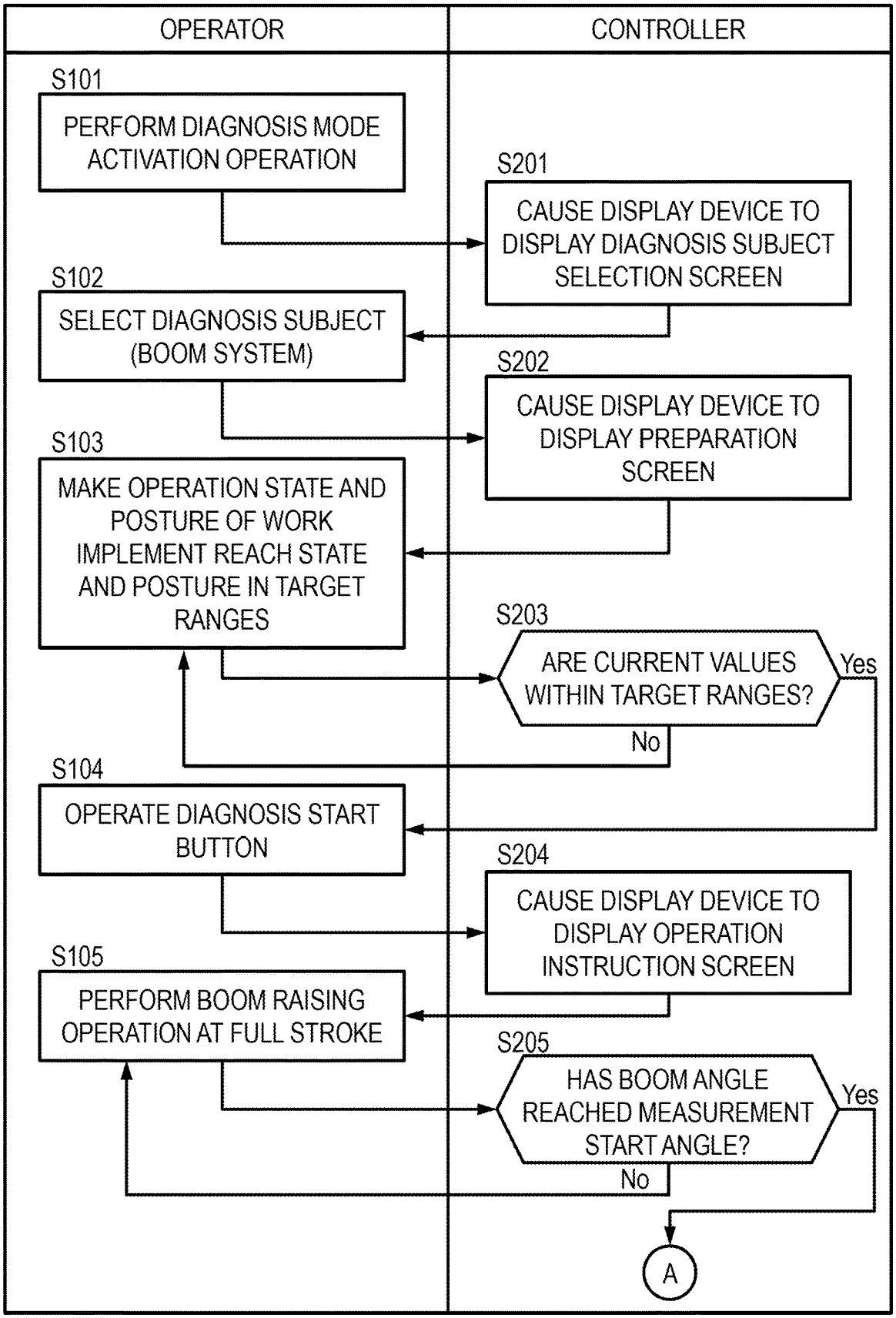
FIG. 6A is a flowchart depicting an example of an operation procedure performed by an operator, and a diagnosis processing procedure performed by the controller, and depicts a procedure from diagnosis mode activation operation until when it is assessed that the boom angle has reached a measurement start angle.
Figure 6B:
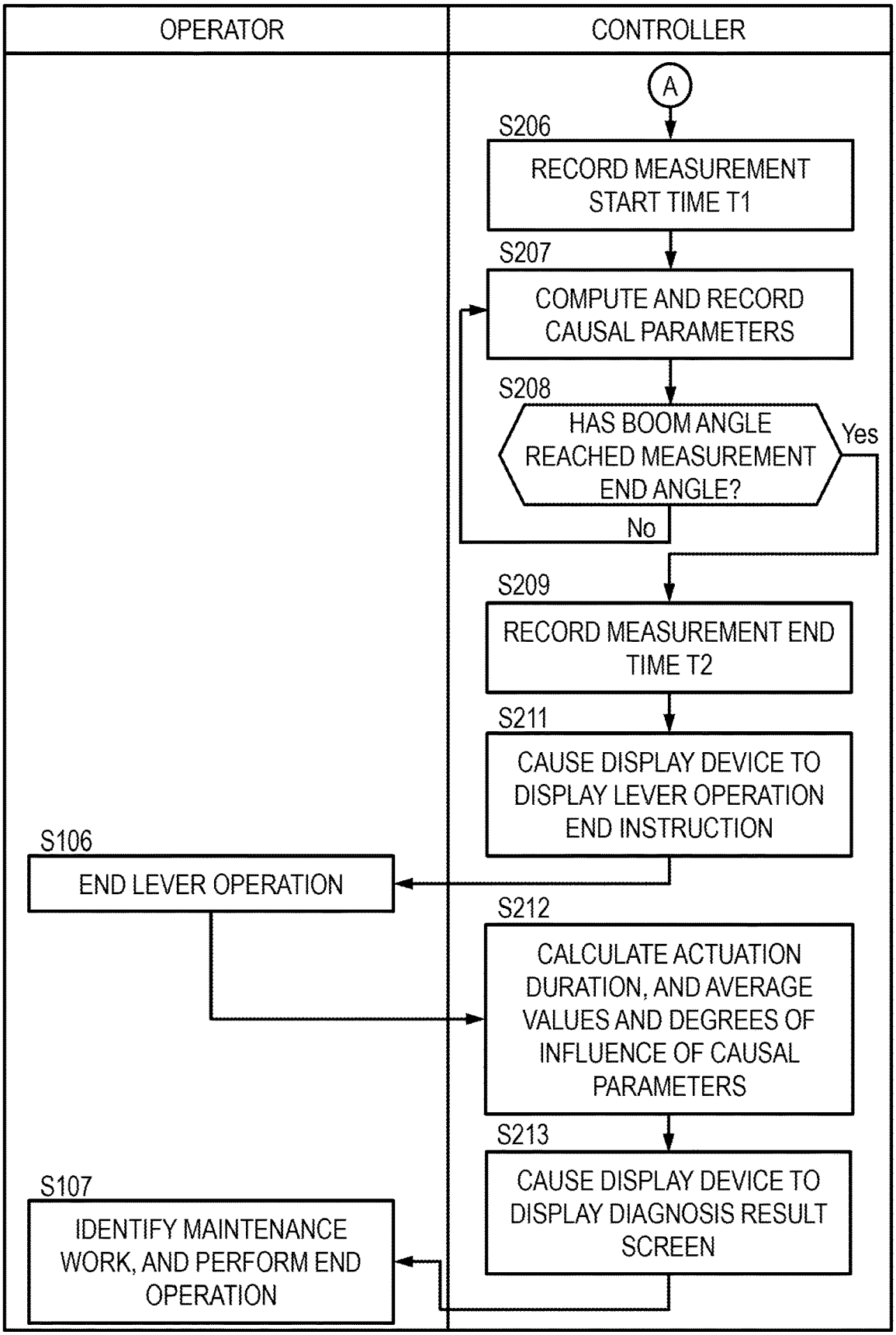
FIG. 6B is a flowchart depicting the example of the operation procedure performed by the operator, and the diagnosis processing procedure performed by the controller, and depicts a procedure from a measurement start time recording process until when end operation is performed.

Hereinbelow, with reference to FIG. 6A, FIG. 6B, and FIG. 7 to FIG. 10, content of diagnosis processes performed by the controller 110, and various types of screen displayed on the display device 62*a* in the diagnosis processes are explained in detail. FIG. 6A and FIG. 6B are flowcharts depicting an example of an operation procedure performed by an operator, and a diagnosis processing procedure performed by the controller 110. As depicted in FIG. 6A, when the operator performs diagnosis mode activation operation using the input device 62*b* at Step S101, the controller 110 activates a diagnosis mode, and starts processes at and after Step S201.

Figure 7:
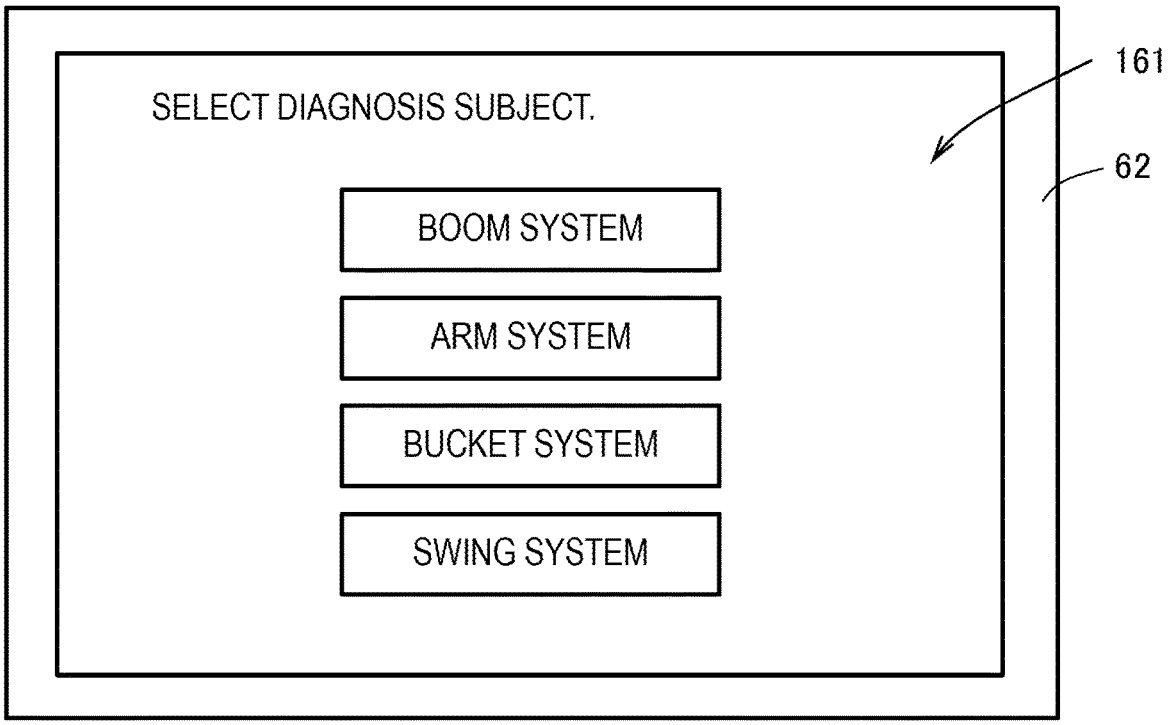
FIG. 7 is a figure depicting an example of a diagnosis subject selection screen.

At Step S201, the controller 110 causes the display device 62*a* to display the diagnosis subject selection screen 161 for allowing the operator to select a diagnosis subject system. FIG. 7 is a figure depicting an example of the diagnosis subject selection screen 161. As depicted in FIG. 7, the diagnosis subject selection screen 161 is a screen for selecting a diagnosis subject system from "BOOM SYSTEM," "ARM SYSTEM," "BUCKET SYSTEM," and "SWING SYSTEM."

At Step S102 depicted in FIG. 6A, the operator performs selection operation to select a diagnosis subject system from a plurality of the systems displayed on the diagnosis subject selection screen 161. It is supposed in the following explanation that the operator has selected the "BOOM SYSTEM" as the diagnosis subject system. When the operation to select the boom system as the diagnosis subject system is performed at Step S102, at Step S202, the controller 110 causes the display device 62*a* to display the diagnosis preparation screen 162 for prompting the operator to perform a preparation for a diagnosis of the boom system.

Figure 8:
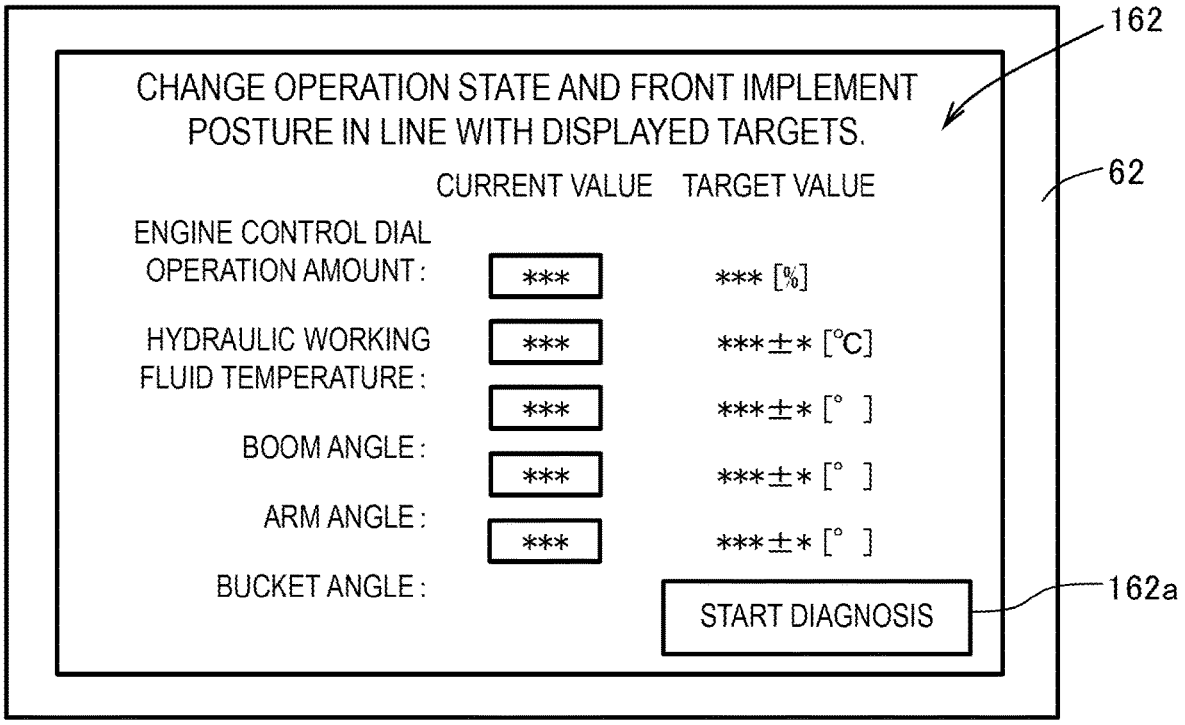
FIG. 8 is a figure depicting an example of a diagnosis preparation screen.

FIG. 8 is a figure depicting an example of the diagnosis preparation screen 162. As depicted in FIG. 8, a target value (target range) and a current value of each of the operation amount of the engine control dial 63, the hydraulic working fluid temperature, the boom angle, the arm angle, and the bucket angle are displayed on the diagnosis preparation screen 162. The current value of the operation amount of the engine control dial 63 is computed from an output result of the engine control dial 63. In addition, the current value of the hydraulic working fluid temperature is computed from a sensing result of the hydraulic working fluid temperature sensor 23A. The current values of the boom angle, arm angle, and bucket angle are computed from sensing results of the boom angle sensor 10A, the arm angle sensor 11A, and the bucket angle sensor 12A.

The target values and target ranges of the operation amount of the engine control dial 63, and the hydraulic working fluid temperature, which are parameters representing the operation state, and the boom angle, arm angle, and bucket angle, which are parameters representing the posture of the work implement 9, are preset, and stored on the non-volatile memory 112. In the present embodiment, as depicted in the figure, the target ranges are displayed as target values and tolerated amounts of deviation from the target values. Note that the display method is not limited to this, but the controller 110 may cause the display device 62*a* to display lower limit values and upper limit values representing target ranges.

In addition, a message "CHANGE OPERATION STATE AND FRONT IMPLEMENT POSTURE IN LINE WITH DISPLAYED TARGETS." for prompting the operator to perform a preparation for the diagnosis is displayed on the diagnosis preparation screen 162. Furthermore, a diagnosis start button 162*a* is displayed on the diagnosis preparation screen 162. Note that the diagnosis start button 162*a* is kept inoperable until a predetermined condition mentioned later is satisfied.

At Step S103 depicted in FIG. 6A, the operator operates the engine control dial 63 and the operation device 61 such that parameters representing the operation state, and parameters representing the posture of the work implement 9 reach values within the target ranges. Note that in a case where work is performed in winter or in a cold region, the hydraulic working fluid temperature is not within the target range immediately after the activation of the engine 21, in some cases. In this case, the operator waits until the hydraulic working fluid temperature reaches a temperature within the target range by warm-up operation.

At Step S203, the controller 110 assesses whether or not all of the current values of the parameters representing the operation state and the posture of the work implement 9 are within the target ranges. When the controller 110 assesses that at least one of the current values of the parameters representing the operation state and the posture of the work implement 9 is not within the target range, the controller 110 maintains the state where the diagnosis start button 162*a* is kept inoperable.

When the controller 110 assesses that all of the current values of the parameters representing the operation state and the posture of the work implement 9 are within the target ranges, the diagnosis start button 162*a* is made operable. In addition, the controller 110 causes the diagnosis preparation screen 162 to display information for informing that the diagnosis start button 162*a* is made operable. For example, by changing the display mode of the diagnosis start button 162*a* on the diagnosis preparation screen 162, the controller 110 informs the operator that the diagnosis start button 162*a* is operable.

At Step S104, the operator operates the diagnosis start button 162*a*. When the diagnosis start button 162*a* is operated, at Step S204, the controller 110 causes the display device 62*a* to display the operation instruction screen 163.

Figure 9:
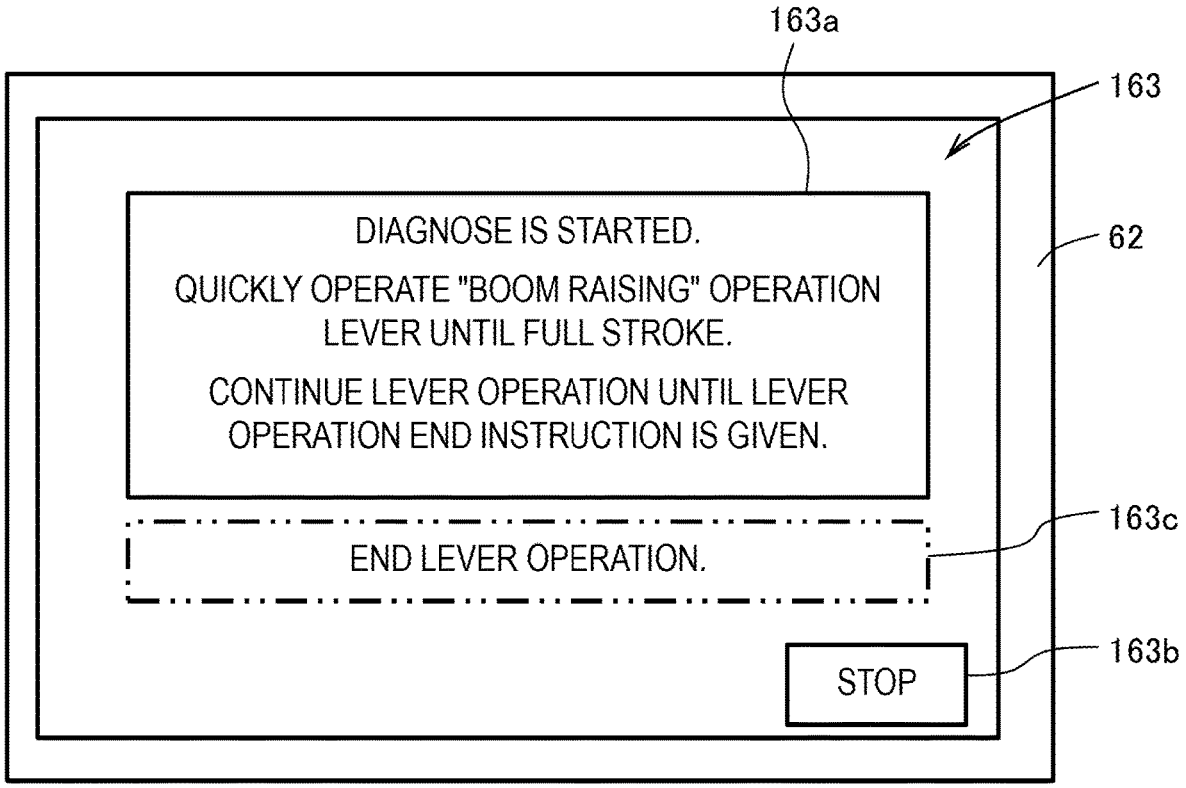
FIG. 9 is a figure depicting an example of an operation instruction screen.

FIG. 9 is a figure depicting an example of the operation instruction screen 163. As depicted in FIG. 9, a message 163*a* explaining a method to operate a hydraulic actuator for the diagnosis, and a stop button 163*b* are displayed on the operation instruction screen 163. As the message 163*a* representing the method to operate the operation device 61 for the diagnosis of the boom system, the message displayed in the present embodiment prompts to promptly operate the operation lever 61*a* toward the boom raising side until full stroke, and maintain the state where the operation lever 61*a* is being operated at full stroke until an end instruction is displayed. The stop button 163*b* is an operation button for stopping the diagnosis. When the stop button 163*b* is operated, the controller 110 stops measurement, and causes the display device 62*a* to display the diagnosis subject selection screen 161.

When the operator operates the operation lever 61*a* toward the boom raising side at Step S105 depicted in FIG. 6A, the controller 110 outputs a command signal to the proportional control valve 26. The proportional control valve 26 generates an operation pressure according to the operation amount of the operation lever 61*a*, and outputs the operation pressure to the flow control valve 24A. When the spool of the flow control valve 24A is moved by the operation pressure, the hydraulic working fluid delivered from the hydraulic pump 22 is supplied to the boom cylinder 13, the boom cylinder 13 extends, and the boom 10 is moved in the raising direction.

The controller 110 computes the boom angle $\alpha$ repeatedly in each predetermined control period on the basis of sensing results of the boom angle sensor 10A. At Step S205, the controller 110 assesses whether or not the boom angle α has reached the measurement start angle α1.

When it is assessed at Step S205 that the boom angle α has reached the measurement start angle α1, the process proceeds to Step S206 (see FIG. 6B). Note that the assessment process at Step S205 is executed repeatedly until it is assessed that the boom angle α has reached the measurement start angle α1.

As depicted in FIG. 6B, at Step S206, the controller 110 records, on the volatile memory 113 and as a measurement start time T1, a time measured by the internal clock at which a result of the assessment process at Step S205 is Yes, and the process proceeds to Step S207.

At Step S207, the controller 110 computes causal parameters on the basis of sensor values, and records computation results on the volatile memory 113 along with the sensor values. Note that the causal parameters are the rotation speed of the hydraulic pump 22, the delivery capacity (volume) of the hydraulic pump 22, the leakage flow rate of the hydraulic working fluid, and the bleed-off flow rate. In addition, the sensor values are sensing results of the engine speed sensor 21A, the tilting angle sensor 22C, the boom angle sensor 10A, and the pressure sensors 22B, 25, and 26A.

At Step S208, the controller 110 assesses whether or not the boom angle α has reached the measurement end angle α2. When it is assessed at Step S208 that the boom angle α has not reached the measurement end angle α2, the process returns to Step S207, and the causal parameters are computed and stored on the basis of the sensor values of the next control period. When it is assessed at Step S208 that the boom angle α has reached the measurement end angle α2, the process proceeds to Step S209.

At Step S209, the controller 110 records, on the volatile memory 113 and as a measurement end time T2, a time measured by the internal clock at which a result of the assessment process at Step S208 is Yes, and the process proceeds to Step S211.

At Step S211, the controller 110 causes the display device 62*a* to display an operation end instruction 163*c* (see FIG. 9) for giving an instruction to end the operation of the operation device 61. When the operator ends the operation of the operation device 61 at Step S106, at Step S212, the controller 110 computes, as boom actuation duration T, the duration from the measurement start time T1 until the measurement end time T2, and records the boom actuation duration T on the volatile memory 113. In addition, at Step S212, the controller 110 computes the averages of the respective causal parameters serially computed from the measurement start time T1 until the measurement end time T2, and records the averages on the volatile memory 113. Furthermore, at Step S212, the controller 110 computes the degree of influence of each of the plurality of causal parameters, and records the degrees of influence on the volatile memory 113.

Figure 10:
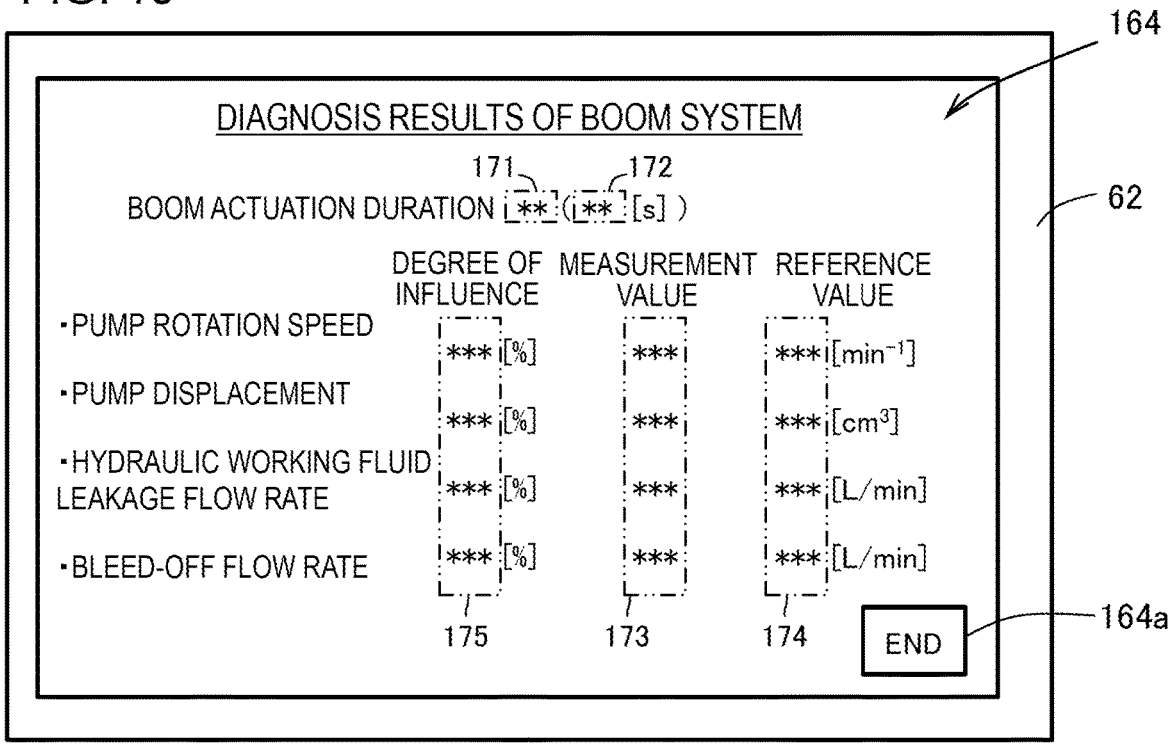
FIG. 10 is a figure depicting an example of a diagnosis result screen.

When the process at Step S212 is ended, the process proceeds to Step S213. At Step S213, the controller 110 causes the display device 62*a* to display the diagnosis result screen 164 representing computation results of Step S212. FIG. 10 is a figure depicting an example of the diagnosis result screen 164. As depicted in FIG. 10, as information representing diagnosis results of the boom system, the boom actuation duration T (171) and the reference value (172) of the boom actuation duration T, and the average (173), reference value (174) and degree of influence (175) of each of the plurality of causal parameters that influence the boom actuation duration T are displayed on the diagnosis result screen 164.

Note that the rotation speed of the hydraulic pump 22 is displayed as "PUMP ROTATION SPEED," and the delivery capacity of the hydraulic pump 22 is displayed as "PUMP DISPLACEMENT" on the diagnosis result screen 164. In addition, the average of each causal parameter serially computed from the measurement start time T1 until the measurement end time T2 is displayed as "MEASUREMENT VALUE" on the diagnosis result screen 164.

As depicted in the figure, the boom actuation duration T (171) and its reference value (172) are displayed on the diagnosis result screen 164 next to each other in a comparative manner. In addition, the averages (173), reference values (174), and degrees of influence (175) of the causal parameters that influence the boom actuation duration T are displayed on the diagnosis result screen 164 next to each other.

If only one certain causal parameter in the plurality of causal parameters has changed from its reference value, the degree of influence of the causal parameter is 1. On the other hand, if a causal parameter has not changed from its reference value, the degree of influence of the causal parameter is 0. In a case where at least two causal parameters have changed from their reference values, the degrees of influence of the two causal parameters have values within the range from 0 to 1. In this manner, the degrees of influence of the causal parameters are used as dimensionless indices relatively representing the magnitudes of influence on a decrease in an actuation performance value (an increase in the actuation duration). Note that, in one possible method to display the degrees of influence, the degrees of influence are displayed as values within the range from 0 to 1, or the degrees of influence may be multiplied by 100, and displayed in a percentage format as depicted in the figure.

At Step S107 depicted in FIG. 6B, the operator checks the display content of the diagnosis result screen 164, and determines whether or not it is necessary to perform maintenance work of the boom system. In a case where the operator determines that maintenance work is necessary, the operator identifies maintenance subject equipment.

Note that, in order to make it easier to visually determine the priority order of maintenance, the controller 110 may cause the diagnosis result screen 164 to display the causal parameters after sorting them in descending order of the magnitudes of the degrees of influence.

When the diagnosis of the boom system is ended, the operator operates an end button 164*a* (see FIG. 10) on the diagnosis result screen 164. In a case where the end button 164*a* is operated, the display control section 104 causes the display device 62*a* to display the diagnosis subject selection screen 161 again. As necessary, the operator selects any of "ARM SYSTEM," "BUCKET SYSTEM," and "SWING SYSTEM," and executes a diagnosis of the hydraulic excavator 1 in accordance with a procedure which is the same as the one described above. Note that since procedures of diagnoses of the arm system, the bucket system, and the swing system are similar to the procedure of the diagnosis of the boom system, explanations thereof are omitted.

According to the embodiment mentioned above, the following actions and effects are attained.

(1) The hydraulic excavator 1 includes: the hydraulic pump 22 that delivers the hydraulic working fluid; a hydraulic actuator (e.g. the boom cylinder 13) driven by the hydraulic working fluid delivered from the hydraulic pump 22; the operation device 61 of the hydraulic actuator; and the flow control valve 24A that has the bleed-off passage section 24B that introduces the hydraulic working fluid delivered from the hydraulic pump 22 to the tank 23 when the flow control valve 24A is at the neutral position, and controls the flow rate of the hydraulic working fluid supplied from the hydraulic pump 22 to the hydraulic actuator according to the operation amount of the operation device 61.

The diagnosis device of the hydraulic excavator (work machine) 1 includes: the display device 62*a* that displays an operation procedure of the hydraulic excavator 1; and the controller 110 that acquires state quantities of the hydraulic excavator 1 from the sensors (10A, 21A, 22B, 22C, 25, and 26A) that sense the state quantities while the hydraulic excavator 1 is being operated in accordance with the operation procedure, and diagnoses the actuation performance of the hydraulic excavator 1 on the basis of the state quantities of the hydraulic excavator 1. Note that the display device 62*a* functions as an output device that outputs an image of diagnosis results obtained by the diagnosis by the controller 110. The controller 110 according to the present embodiment measures, as an actuation performance value, the actuation duration of the hydraulic actuator during which the hydraulic excavator 1 is being moved in accordance with an operation procedure of the hydraulic excavator 1. Specifically, the controller 110 measures, as an actuation performance value, duration required for causing the hydraulic actuator to perform an action by a predetermined actuation range.

The controller 110 acquires sensor values sensed by the sensors (10A, 21A, 22B, 22C, 25, and 26A) provided to the hydraulic excavator 1 when the hydraulic excavator 1 is being moved in accordance with the operation procedure of the hydraulic excavator 1. The controller 110 measures an actuation performance value (e.g. the actuation duration of the boom cylinder 13) representing predetermined actuation performance of the hydraulic excavator 1, and a plurality of causal parameters that influence the actuation performance value, on the basis of the plurality of state quantities sensed by the sensors (10A, 21A, 22B, 22C, 25, and 26A).

The controller 110 according to the present embodiment measures, as the plurality of causal parameters, the rotation speed of the hydraulic pump 22, the delivery capacity (pump displacement) of the hydraulic pump 22, the leakage flow rate of the hydraulic working fluid, and the bleed-off flow rate on the basis of the plurality of state quantities sensed by the sensors (10A, 21A, 22B, 22C, 25, and 26A) when the hydraulic excavator 1 is being moved in accordance with the operation procedure of the hydraulic excavator 1. The controller 110 computes the degree of influence Z of each of the plurality of causal parameters on the actuation performance value on the basis of the measurement values N, q, Ql, and Qb of the plurality of causal parameters, and the reference value Nn, qn, Qln, or Qbn preset for each of the plurality of causal parameters.

The controller 110 outputs, to the display device 62*a*, the computed actuation performance value and degrees of influence Z. The display device 62*a* displays the actuation performance value and the degrees of influence Z on the display screen. That is, the controller 110 controls the display device 62*a* to cause the display device 62*a* to output the actuation duration of the hydraulic actuator, which is an actuation performance value, and the degrees of influence Z(N), Z(q), Z(Ql), and Z(Qb).

Accordingly, an operator can know causal parameters with significant degrees of influence on the actuation performance value of the hydraulic excavator 1 in the plurality of causal parameters, and can easily and promptly identify maintenance subject equipment. Thus, the operator can appropriately make a plan of a maintenance schedule, and can enhance the efficiency of maintenance work. Since the duration of the maintenance work can be reduced, the operation duration of the hydraulic excavator 1 can be increased. As a result, the efficiency of work by the hydraulic excavator 1 such as excavation can be enhanced.

(2) The controller 110 causes one screen of the display device 62*a* to display the degree of influence (175) of each of the plurality of causal parameters along with the actuation performance value (boom actuation duration T (171)) (see FIG. 10). Here, in a case where the actuation performance value and the degrees of influence are displayed on different screens, it becomes necessary to switch the screens. In contrast, since the actuation performance value and the degrees of influence are displayed on the one screen in the present embodiment, it is not necessary for the operator to perform screen switching operation, and the operator can easily grasp the relationship between them.

(3) The controller 110 causes the measurement value (average), degree of influence, and reference value of each of the plurality of causal parameters to be displayed on the one screen of the display device 62*a* next to each other (see FIG. 10). According to this configuration, the operator can easily determine the degree of normality of each causal parameter (deviation of the measured causal parameter from the reference value). As a result, the operator can more appropriately identify maintenance subject equipment, and make a plan of a maintenance schedule.

Second Embodiment

Figure 11:
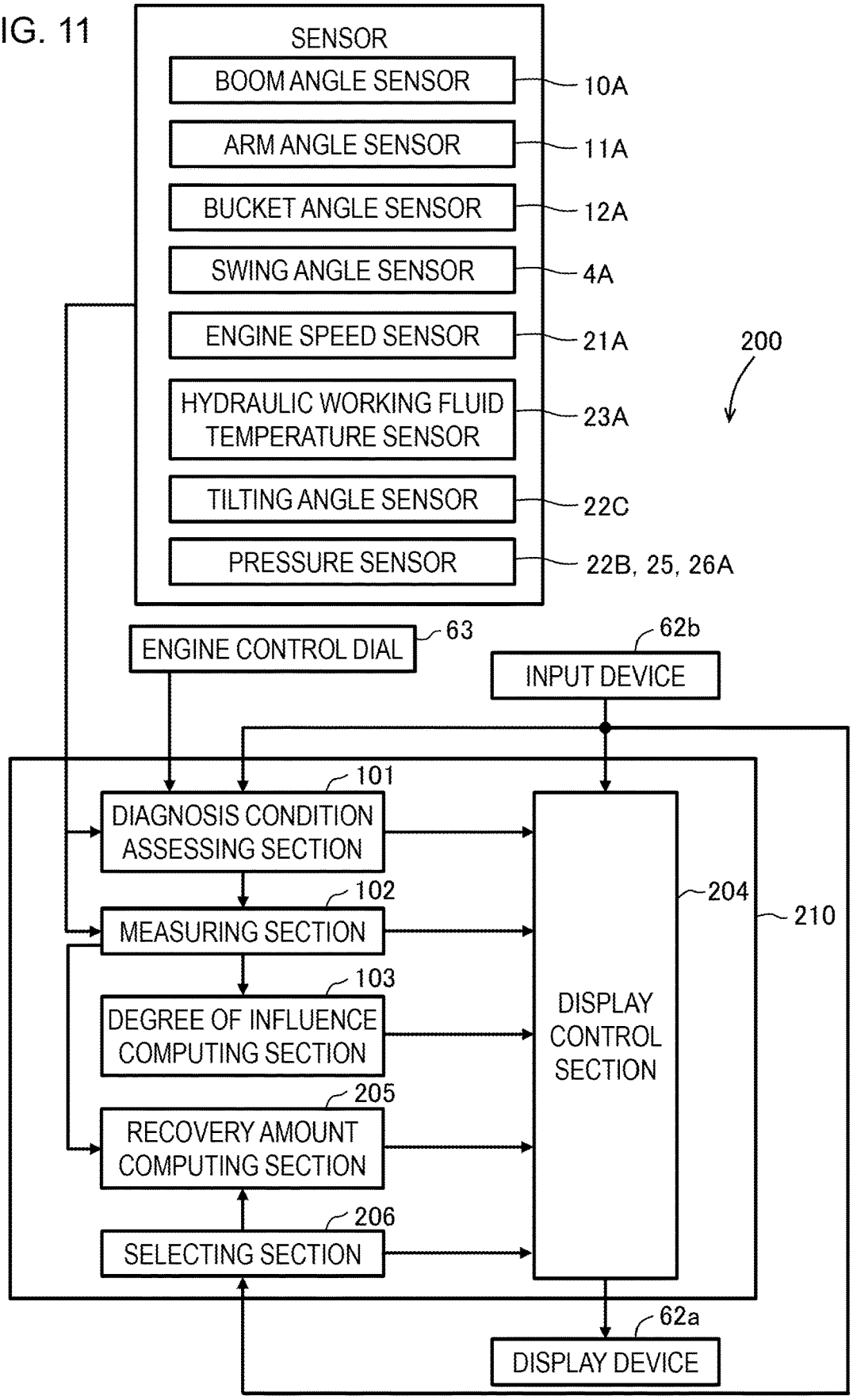
FIG. 11 is a functional block diagram of a controller of a diagnosis device according to a second embodiment.
Figure 12:
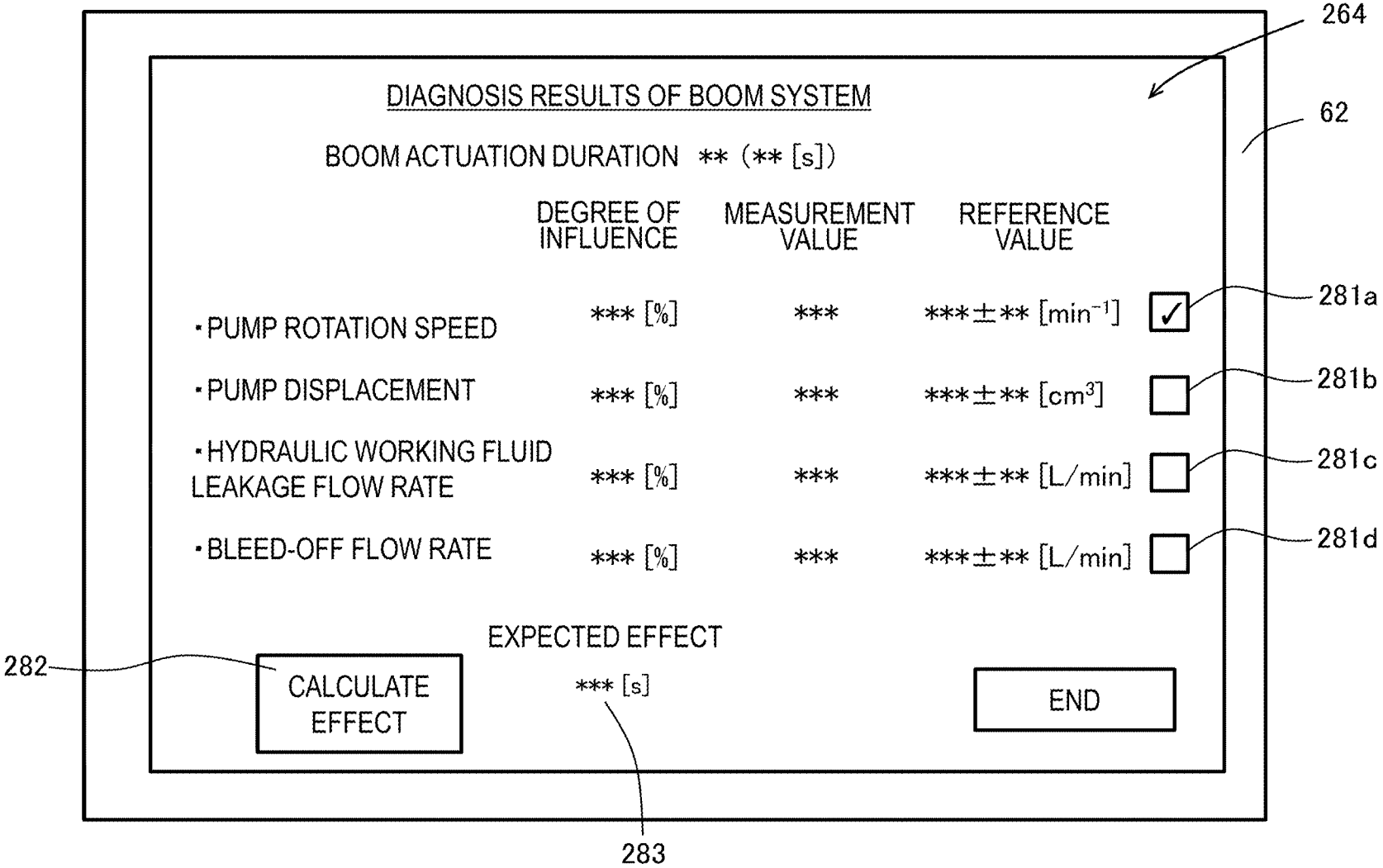
FIG. 12 is a figure depicting an example of a diagnosis result screen displayed on a display device of the diagnosis device according to the second embodiment.

With reference to FIG. 11 and FIG. 12, a diagnosis device 200 according to a second embodiment of the present invention is explained. FIG. 11 is a functional block diagram of a controller 210 of the diagnosis device 200 according to the second embodiment. FIG. 12 is a figure depicting an example of a diagnosis result screen 264 displayed on the display device 62*a* of the diagnosis device 200 according to the second embodiment. Note that constituent elements identical or equivalent to constituent elements explained in the first embodiment are given identical reference symbols, and differences are explained mainly.

The controller 210 according to the present second embodiment selects one or more causal parameters from a plurality of causal parameters on the basis of a signal input from the input device 62*b*, and computes a recovery amount of an actuation performance value supposing that the selected causal parameters recover from measurement values to reference values. That is, the controller 210 computes a recovery amount of the actuation performance value supposing that the degrees of influence of the selected causal parameters are 0 (zero). The controller 210 causes the display device 62*a* to output the computed recovery amount.

Specifically, the controller 210 computes, in accordance with Formula (11) below, a recovery amount ΔTr of the actuation performance value (actuation duration) supposing that the selected causal parameters recover from the measurement values to the reference values, and causes the display device 62*a* to output the computed recovery amount ΔTr.

[Math. 11]

$$\Delta T_r = Q_a\left(\frac{1}{N \cdot q - Q_l - Q_b} - \frac{1}{N' \cdot q' - Q_l' - Q_b'}\right) \quad (11)$$

Here, N' is the reference value Nn of the rotation speed of the hydraulic pump 22 in a case where the rotation speed of the hydraulic pump 22 is selected from the plurality of causal parameters, and is the measurement value N of the rotation speed of the hydraulic pump 22 in a case where the rotation speed of the hydraulic pump 22 is not selected from the plurality of causal parameters. q' is the reference value qn of the delivery capacity of the hydraulic pump 22 in a case where the delivery capacity of the hydraulic pump 22 is selected from the plurality of causal parameters, and is the measurement value q of the delivery capacity of the hydraulic pump 22 in a case where the delivery capacity of the hydraulic pump 22 is not selected from the plurality of causal parameters. Ql' is the reference value Qln of the leakage flow rate of the hydraulic working fluid in a case where the leakage flow rate of the hydraulic working fluid is selected from the plurality of causal parameters, and is the measurement value Ql of the leakage flow rate of the hydraulic working fluid in a case where the leakage flow rate of the hydraulic working fluid is not selected from the plurality of causal parameters. Qb' is the reference value Qbn of the bleed-off flow rate in a case where the bleed-off flow rate is selected from the plurality of causal parameters, and is the measurement value Qb of the bleed-off flow rate in a case where the bleed-off flow rate is not selected from the plurality of causal parameters.

According to this configuration, an operator can select certain causal parameters, and check a recovery amount supposing that the selected causal parameters recover from measurement values to the reference values. Accordingly, the operator can easily grasp an effect that can be expected in a case where maintenance is performed, and can appropriately make a maintenance plan. In addition, since a plurality of causal parameters can be selected in combination according to this configuration, the operator can make a maintenance plan more easily as compared to a case where only a single causal parameter can be selected.

Hereinbelow, with reference to FIG. 11 and FIG. 12, functions of the controller 210, and specific examples of the diagnosis result screen 264 displayed on the display device 62*a* according to the second embodiment are explained. As depicted in FIG. 11, the controller 210 has functions as a recovery amount computing section 205 and a selecting section 206 in addition to the functions of the controller 110 explained with reference to the first embodiment. The selecting section 206 selects one or more causal parameters from the plurality of causal parameters on the basis of a signal input from the input device 62*b*.

As depicted in FIG. 12, selection boxes 281*a*, 281*b*, 281*c*, and 281*d* corresponding to the respective causal parameters, an effect calculation button 282, and an expected effect display section 283 are included in the diagnosis result screen 264 displayed on the display device 62*a*. When an operator performs touch operation of the selection boxes 281*a*, 281*b*, 281*c*, and 281*d* on the touch panel monitor 62, the selecting section 206 selects, as recovery amount computation subjects, causal parameters corresponding to the selection boxes on which the touch operation is performed. For example, when touch operation of the selection box 281*a* is performed, the selecting section 206 selects the rotation speed of the hydraulic pump 22. In addition, in a case where the rotation speed of the hydraulic pump 22 is selected, a display control section 204 causes the selection box 281*a* to display a check mark representing that the rotation speed of the hydraulic pump 22 is selected.

The selecting section 206 assesses whether or not touch operation of the effect calculation button 282 is performed. When the selecting section 206 assesses that the touch operation of the effect calculation button 282 is performed, the recovery amount computing section 205 computes a recovery amount supposing that the degrees of influence Z of causal parameters selected by the selecting section 206 are 0 (zero). The recovery amount is equivalent to the difference between the actuation duration (actuation performance value) computed by the measuring section 102 and the actuation duration (actuation performance value) supposing that the degrees of influence Z of the selected causal parameters are 0 (zero).

In a case where only the rotation speed of the hydraulic pump 22 is selected, the recovery amount computing section 205 computes, in accordance with Formula (12) below, a recovery amount (expected effect) ΔTr (N) supposing that the rotation speed of the hydraulic pump 22 recovers from the measurement value N to the reference value Nn.

[Math. 12]

$$\Delta T_r(N) = Q_a\left(\frac{1}{N \cdot q - Q_l - Q_b} - \frac{1}{N_n \cdot q - Q_l - Q_b}\right) \quad (12)$$

In a case where only the delivery capacity of the hydraulic pump 22 is selected, the recovery amount computing section 205 computes, in accordance with Formula (13) below, a recovery amount (expected effect) ΔTr (q) supposing that the delivery capacity of the hydraulic pump 22 recovers from the measurement value q to the reference value qn.

[Math. 13]

$$\Delta T_r(q) = Q_a\left(\frac{1}{N \cdot q - Q_l - Q_b} - \frac{1}{N \cdot q_n - Q_l - Q_b}\right) \quad (13)$$

In a case where only the leakage flow rate of the hydraulic working fluid is selected, the recovery amount computing section 205 computes, in accordance with Formula (14) below, a recovery amount (expected effect) ΔTr(Ql) supposing that the leakage flow rate of the hydraulic working fluid recovers from the measurement value Ol to the reference value Qln.

[Math. 14]

$$\Delta T_r(Q_l) = Q_a\left(\frac{1}{N \cdot q - Q_l - Q_b} - \frac{1}{N \cdot q - Q_{ln} - Q_b}\right) \quad (14)$$

In a case where only the bleed-off flow rate is selected, the recovery amount computing section 205 computes, in accordance with Formula (15) below, a recovery amount (expected effect) ΔTr(Qb) supposing that the bleed-off flow rate recovers from the measurement value Qb to the reference value Qbn.

[Math. 15]

$$\Delta T_r(Q_b) = Q_a\left(\frac{1}{N \cdot q - Q_l - Q_b} - \frac{1}{N \cdot q - Q_l - Q_{bn}}\right) \quad (15)$$

After the recovery amount computing section 205 computes a recovery amount, the display control section 204 outputs the computed recovery amount to the display device 62*a*. The display device 62*a* causes the expected effect display section 283 to display the input recovery amount.

The recovery amount computing section 205 computes also a recovery amount supposing that a plurality of causal parameters are selected by the selecting section 206. For example, the recovery amount computing section 205 computes, in accordance with Formula (16) below, a recovery amount (expected effect) ΔTr(Ql, Qb) supposing that the leakage flow rate of the hydraulic working fluid and the bleed-off flow rate recover from the measurement values Ql and Qb to the reference values Qln and Qbn, respectively.

[Math. 16]

$$\Delta T_r(Q_l, Q_b) = Q_a\left(\frac{1}{N \cdot q - Q_l - Q_b} - \frac{1}{N \cdot q - Q_{ln} - Q_{bn}}\right) \quad (16)$$

Figure 13:
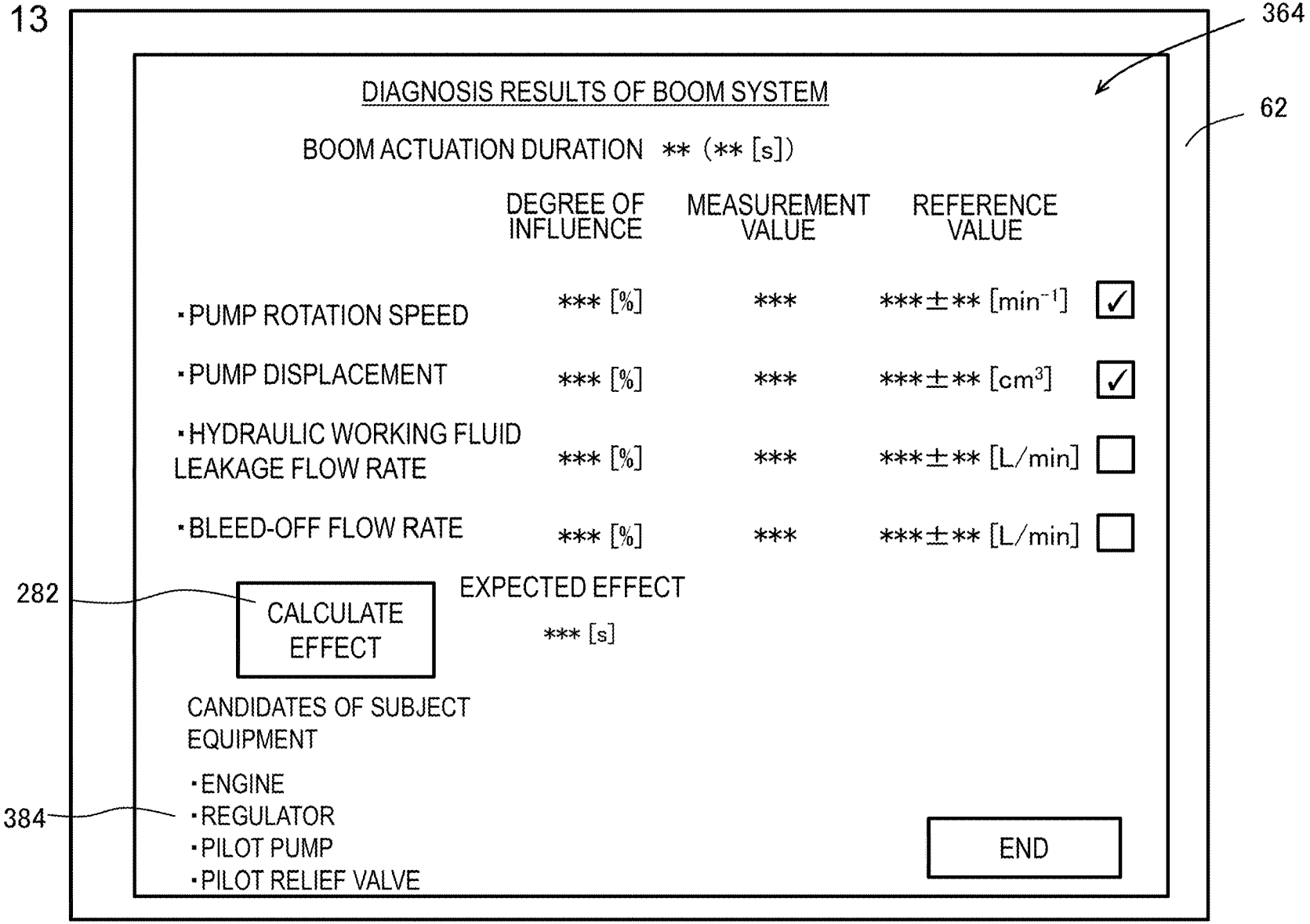
FIG. 13 is a figure depicting another example of a diagnosis result screen displayed on the display device of the diagnosis device according to the second embodiment.

Note that the controller 210 may cause the display device 62*a* to display candidates of maintenance subject equipment when selected causal parameters are caused to recover. FIG. 13 is a figure depicting another example of a diagnosis result screen 364 displayed on the display device 62*a* of the diagnosis device 200 according to the second embodiment. As depicted in FIG. 13, when the effect calculation button 282 is operated, the display control section 204 causes a candidate display section 384 of the diagnosis result screen 364 to display candidates of maintenance subject equipment for recovering selected causal parameters.

The non-volatile memory 112 has stored thereon causal parameters and candidates of maintenance subject equipment in association with each other. The rotation speed of the hydraulic pump 22 as a causal parameter is stored in association with the engine 21 as a candidate of maintenance subject equipment. The delivery capacity of the hydraulic pump 22 as a causal parameter is stored in association with the regulator 22A, the pilot pump, and the pilot relief valve 29 as candidates of maintenance subject equipment. The leakage flow rate of the hydraulic working fluid as a causal parameter is stored in association with the hydraulic pump 22 and the hydraulic actuators as candidates of maintenance subject equipment. The bleed-off flow rate as a causal parameter is stored in association with the proportional control valves 26, the control valve 24, the pilot pump, and the pilot relief valve 29 as candidates of maintenance subject equipment.

Since candidates of maintenance subject equipment are displayed on the display device 62*a* in this manner, even a less-experienced operator can appropriately make a maintenance plan.

Modification examples like the ones mentioned below are also included in the scope of the present invention, and it is also possible to combine constituent elements depicted in the modification examples and constituent elements explained in the embodiments mentioned above, combine constituent elements explained in different embodiments mentioned above, combine constituent elements explained in different modification examples below, and so on.

First Modification Example

Whereas the controllers 110 and 210 cause the averages of causal parameters computed repeatedly in predetermined control periods with a measurement range to be displayed as measurement values in the examples explained in the embodiments described above, the present invention is not limited to this. The controllers 110 and 210 may cause the minimum values or maximum values of causal parameters computed repeatedly in predetermined control periods within a measurement range to be displayed as measurement values.

Second Modification Example

Whereas the touch panel monitor 62 functions as an output device that outputs diagnosis results (information) in the examples explained in the embodiments described above, the present invention is not limited to this. Separately from the touch panel monitor 62 that displays an operation procedure when a diagnosis of the hydraulic excavator 1 is to be performed, an output device that outputs diagnosis results may be provided. For example, the diagnosis devices 100 and 200 may include, as an output device, a sound output device such as a speaker that outputs diagnosis results as sound. In addition, the diagnosis devices 100 and 200 may include, as an output device, a printing device that outputs diagnosis results by printing them on paper. Furthermore, the diagnosis devices 100 and 200 may include, as an output device, a communication device that transmits diagnosis results to an external information terminal. In this case, screens (see FIG. 10, FIG. 12, and FIG. 13) representing diagnosis results are displayed on a display section of the external information terminal.

Third Modification Example

The hydraulic excavator 1 includes the touch panel monitor 62 that doubles as a display device and an input device in the examples explained in the embodiments described above. However, the present invention is not limited to this. The hydraulic excavator 1 may include the display device 62*a* and the input device 62*b* separately.

Fourth Modification Example

Whereas the controllers 110 and 210 compute the bleed-off flow rate using the bleed-off flow rate table (see FIG. 5) in the examples explained in the embodiments described above, the present invention is not limited to this. A flow rate sensor may be provided on the center bypass line 17, and the controllers 110 and 210 may compute the bleed-off flow rate of the hydraulic working fluid passing through the bleed-off passage section 24B of the flow control valve 24A on the basis of sensing results of the flow rate sensor.

Fifth Modification Example

Whereas the diagnosis devices 100 and 200 are mounted on the hydraulic excavator 1 in the examples explained in the embodiments described above, the present invention is not limited to this. The diagnosis devices 100 and 200 may be provided outside the hydraulic excavator 1. In this case, a controller mounted on the hydraulic excavator 1 transmits acquired sensor values to an external terminal device via a communication device. A controller of the external terminal device measures an actuation performance value and causal parameters similarly to the embodiments described above on the basis of the acquired sensor values, and, on the basis of measurement results thereof, computes the degrees of influence of the causal parameters. The controller of the external terminal device causes a display device of the external terminal device to display the actuation performance value (actuation duration) and the degrees of influence.

In this configuration, in a case where the hydraulic excavator 1 is operated remotely, the hydraulic excavator 1 can be moved in accordance with an operation procedure displayed on the display device of the external terminal device. Thus, a diagnosis of the hydraulic excavator 1 can be performed even in a case where an operator is not in the hydraulic excavator 1.

Sixth Modification Example

The input device 62*b* is operated to thereby select certain causal parameters as recovery amount computation subjects in the example explained in the second embodiment. However, the present invention is not limited to this. The controller 210 may compute a recovery amount of the actuation performance value supposing that the degree of influence of a preset predetermined causal parameter in the plurality of causal parameters is 0 (zero), and cause the display screen of the display device 62*a* to display the recovery amount. In addition, the controller 210 may select, as a recovery amount computation subject, a causal parameter with the most significant degree of influence in the plurality of causal parameters. Thus, the recovery amount of the causal parameter with the degree of influence on the actuation performance value more significant than those of other causal parameters is displayed on the display screen of the display device 62*a* independently of selection by an operator. According to the present modification example, the time and effort of selection operation by the operator can be reduced.

As mentioned above, the controller 210 according to the second embodiment and the present modification example computes a recovery amount of the actuation performance value supposing that any of the plurality of causal parameters recovers from a measurement value to the reference value, and causes the display device 62*a* to output the recovery amount. According to this configuration, the operator can easily grasp an effect that can be expected in a case where maintenance is performed. Accordingly, as compared to a diagnosis device that does not output recovery amounts, the operator can more appropriately make a maintenance plan.

Seventh Modification Example

One of the boom system, the arm system, the bucket system, and the swing system is selected, and, in a case where the boom system is selected, a diagnosis of the boom system is performed, and diagnosis results thereof are displayed on the display device 62*a* in the examples explained in the embodiments described above. However, the present invention is not limited to this. For example, in the second embodiment, in a case where a recovery of another system such as the arm system, the bucket system, or the swing system also can be expected in a case where a causal parameter selected by using the selection boxes 281*a* to 281*d* recovers from a measurement value to the reference value, the controller 210 may cause the diagnosis result screen 264 of the boom system to display a message to that effect.

Eighth Modification Example

The actuation performance of the hydraulic cylinders 13 to 15 and swing motor 3A is diagnosed in the examples explained in the embodiments described above. However, the present invention is not limited to this. The present invention may be applied to a diagnosis of the actuation performance of a travel motor which is a travel hydraulic motor that causes the lower travel structure 2 to travel. For example, the diagnosis device measures, as the actuation duration of the travel motor, duration required for the lower travel structure 2 to travel a predetermined distance. In addition, the present invention is not necessarily applied only to a case where the actuation duration is measured as an actuation performance value. The diagnosis device may measure, as an actuation performance value, the rotation speed of the travel motor when the travel motor is operated with a predetermined operation amount.

Ninth Modification Example

Some or all of the functions of the controllers 110 and 210 explained in the embodiments described above may be realized with hardware (e.g. by designing logic to execute the respective functions using an integrated circuit, and so on).

Whereas embodiments of the present invention have been explained thus far, the embodiments described above are depicted merely as some of application examples of the present invention, and it is not aimed to limit the technical scope of the present invention to the specific configuration of the embodiments described above. The embodiments and modification examples mentioned above are illustrated for explaining the present invention in an easy to understand manner, and the present invention is not necessarily limited to ones including all constituent elements explained. In addition, some of the constituent elements of an embodiment or a modification example can be replaced with constituent elements of another embodiment or modification example, and a constituent element of an embodiment or a modification example can also be added to the constituent elements of another embodiment or modification example. Note that control lines and information lines depicted in figures are ones that are considered to be necessary for explanation, and all control lines and information lines that are necessary for products are not necessarily depicted. It may be considered that actually almost all constituent elements are interconnected.

In addition, whereas the work machine is the hydraulic excavator 1 in examples explained in the embodiments described above, the present invention can be applied to various work machines such as wheel type excavators, wheel loaders, or forklifts.

Description of Reference Characters

1: Hydraulic excavator (work machine)
2: Lower travel structure
3: Swing device
3A: Swing motor (hydraulic actuator)
4: Upper swing structure
4A: Swing angle sensor (sensor)
9: Work implement

10: Boom (drive subject member)
10A: Boom angle sensor (sensor)
11: Arm (drive subject member)
11A: Arm angle sensor (sensor)
12: Bucket (drive subject member)
12A: Bucket angle sensor (sensor)
13: Boom cylinder (hydraulic cylinder hydraulic actuator)
14: Arm cylinder (hydraulic cylinder hydraulic actuator)
15: Bucket cylinder (hydraulic cylinder hydraulic actuator)
17: Center bypass line
21: Engine
21A: Engine speed sensor (sensor)
22: Hydraulic pump
22A: Regulator
22B: Pressure sensor (sensor)
22C: Tilting angle sensor (sensor)
23: Tank
23A: Hydraulic working fluid temperature sensor (sensor)
24: Control valve
24A: Flow control valve
24B: Bleed-off passage section
24PA, 24PB: Pilot pressure receiving section
25: Pressure sensor (sensor)
26: Proportional control valve
26A: Pressure sensor (sensor)
27: Pilot line
28: Pilot hydraulic fluid source
29: Pilot relief valve
61: Operation device
61*a*: Operation lever
61*b*: Operation amount sensor (sensor)
62: Touch panel monitor
62*a*: Display device (output device)
62*b*: Input device
63: Engine control dial
100: Diagnosis device
101: Diagnosis condition assessing section
102: Measuring section
103: Degree of influence computing section
104: Display control section
110: Controller
111: Processing device
112: Non-volatile memory
113: Volatile memory
161: Diagnosis subject selection screen
162: Diagnosis preparation screen
163: Operation instruction screen
164: Diagnosis result screen
200: Diagnosis device
204: Display control section
205: Recovery amount computing section
206: Selecting section
210: Controller
264: Diagnosis result screen
281*a*, 281*b*, 281*c*, 281*d*: Selection box
364: Diagnosis result screen

The invention claimed is:

1. A work machine diagnosis device comprising:

a display device that displays an operation procedure of a work machine;

a controller that acquires a plurality of state quantities from a sensor that senses the plurality of state quantities of the work machine while the work machine is being operated in accordance with the operation procedure, and is configured to diagnose actuation performance of the work machine based on the plurality of state quantities of the work machine; and an output device that outputs a diagnosis result obtained by the diagnosis by the controller, wherein the output device is the display device, and the controller is configured to measure, based on the plurality of state quantities sensed by the sensor, an actuation performance value representing predetermined actuation performance of the work machine and a plurality of causal parameters that influence the actuation performance value, compute a degree of influence of each of the plurality of causal parameters on the actuation performance value based on measurement values of the plurality of causal parameters and a reference value preset for each of the plurality of causal parameters, compute a recovery amount of the actuation performance value supposing that any of the plurality of causal parameters recovers from the measurement value to the reference value, and cause one screen of the display device to display the actuation performance value, the degree of influence of each of the plurality of causal parameters, and the recovery amount.

2. The work machine diagnosis device according to claim 1, wherein the work machine diagnosis device includes an input device that inputs a signal according to operation by an operator to the controller, and the controller is configured to select one or more causal parameters from the plurality of causal parameters on a basis of the signal input from the input device, compute a recovery amount of the actuation performance value supposing that the selected causal parameters recover from the measurement values to the reference values, and cause the display device to display the recovery amount.

3. The work machine diagnosis device according to claim 1, wherein the controller is configured to cause the one screen of the display device to display, next to each other, the measurement value, the degree of influence, and the reference value of each of the plurality of causal parameters.

4. The work machine diagnosis device according to claim 1, wherein the work machine includes: a hydraulic pump that delivers a hydraulic working fluid; a hydraulic actuator driven by the hydraulic working fluid delivered from the hydraulic pump; an operation device of the hydraulic actuator; and a flow control valve that has a bleed-off passage section that introduces the hydraulic working fluid delivered from the hydraulic pump to a tank when the flow control valve is at a neutral position, and controls a flow rate of the hydraulic working fluid supplied from the hydraulic pump to the hydraulic actuator according to an operation amount of the operation device, and the controller is configured to measure, as the actuation performance value, actuation duration of the hydraulic actuator during which the work machine is being moved in accordance with the operation procedure, and measure, as the plurality of causal parameters, a rotation speed of the hydraulic pump, a delivery capacity of the hydraulic pump, a leakage flow rate of the hydraulic working fluid, and a bleed-off flow rate on a basis of the plurality of state quantities sensed by the sensor while the work machine is being moved in accordance with the operation procedure.

5. The work-machine diagnosis device according to claim 4, wherein supposing that an amount of the hydraulic working fluid having flowed into the hydraulic actuator during the actuation duration of the hydraulic actuator is Qa, the measurement value of the rotation speed of the hydraulic pump is N, the reference value of the rotation speed of the hydraulic pump is Nn, the measurement value of the delivery capacity of the hydraulic pump is q, the reference value of the delivery capacity of the hydraulic pump is qn, the measurement value of the leakage flow rate of the hydraulic working fluid is Ql, the reference value of the leakage flow rate of the hydraulic working fluid is Qln, the measurement value of the bleed-off flow rate is Qb, and the reference value of the bleed-off flow rate is Qbn, the controller is configured to compute, in accordance with Formula (1) below, a temporal difference ΔT(N) between the actuation duration of the hydraulic actuator supposing that only the rotation speed of the hydraulic pump in the plurality of causal parameters is the measurement value N, and other causal parameters in the plurality of causal parameters than the rotation speed of the hydraulic pump are the reference values qn, Qln, and Qbn, and reference actuation duration which is the actuation duration of the hydraulic actuator supposing that all of the plurality of causal parameters are the reference values Nn, qn, Qln, and Qbn

[Math. 1]

$$\Delta T(N) = Q_a\left(\frac{1}{N \cdot q_n - Q_{ln} - Q_{bn}} - \frac{1}{N_n \cdot q_n - Q_{ln} - Q_{bn}}\right), \quad (1)$$

compute, in accordance with Formula (2) below, a temporal difference ΔT(q) between the actuation duration of the hydraulic actuator supposing that only the delivery capacity of the hydraulic pump in the plurality of causal parameters is the measurement value q, and other causal parameters in the plurality of causal parameters than the delivery capacity of the hydraulic pump are the reference values Nn, Qln, and Qbn, and the reference actuation duration

[Math. 2]

$$\Delta T(q) = Q_a\left(\frac{1}{N_n \cdot q - Q_{ln} - Q_{bn}} - \frac{1}{N_n \cdot q_n - Q_{ln} - Q_{bn}}\right), \quad (2)$$

compute, in accordance with Formula (3) below, a temporal difference ΔT(Ql) between the actuation duration of the hydraulic actuator supposing that only the leakage flow rate of the hydraulic working fluid in the plurality of causal parameters is the measurement value Q1, and other causal parameters in the plurality of causal parameters than the leakage flow rate of the hydraulic working fluid are the reference values Nn, qn, and Qbn, and the reference actuation duration

[Math. 3]

$$\Delta T(Q_l) = Q_a\left(\frac{1}{N_n \cdot q_n - Q_l - Q_{bn}} - \frac{1}{N_n \cdot q_n - Q_{ln} - Q_{bn}}\right), \quad (3)$$

compute, in accordance with Formula (4) below, a temporal difference ΔT(Qb) between the actuation duration of the hydraulic actuator supposing that only the bleed-off flow rate in the plurality of causal parameters is the measurement value Qb, and other causal parameters in the plurality of causal parameters than the bleed-off flow rate are the reference values Nn, qn, and Qln, and the reference actuation duration

[Math. 4]

$$\Delta T(Q_b) = Q_a\left(\frac{1}{N_n \cdot q_n - Q_{ln} - Q_b} - \frac{1}{N_n \cdot q_n - Q_{ln} - Q_{ln}}\right), \quad (4)$$

compute a sum total ATs of the temporal differences ΔT(N), ΔT(q), ΔT(Ql), and ΔT(Qb), compute a degree of influence Z(N) of the rotation speed of the hydraulic pump on the actuation duration of the hydraulic actuator in accordance with Formula (5) below

[Math. 5]

$$Z(N) = \frac{\Delta T(N)}{\Delta T_s}, \quad (5)$$

compute a degree of influence Z(q) of the delivery capacity of the hydraulic pump on the actuation duration of the hydraulic actuator in accordance with Formula (6) below

[Math. 6]

$$Z = \frac{\Delta T(q)}{\Delta T_s}, \quad (6)$$

compute a degree of influence Z(Ql) of the leakage flow rate of the hydraulic working fluid on the actuation duration of the hydraulic actuator in accordance with Formula (7) below

[Math. 7]

$$Z(Q_l) = \frac{\Delta T(Q_l)}{\Delta T_s}, \quad (7)$$

compute a degree of influence Z(Qb) of the bleed-off flow rate on the actuation duration of the hydraulic actuator in accordance with Formula (8) below

[Math. 8]

$$Z(Q_b) = \frac{\Delta T(Q_b)}{\Delta T_s}, \quad (8)$$

and cause the display device to display the actuation duration of the hydraulic actuator, and the degrees of influence Z(N), Z(q), Z(Ql), and Z(Qb).

6. The work machine diagnosis device according to claim 5, wherein the work machine diagnosis device includes an input device that inputs, to the controller, a signal according to operation by an operator, and the controller is configured to select one or more causal parameters from the plurality of causal parameters on a basis of the signal input from the input device, compute, in accordance with Formula (9) below, a recovery amount ΔTr of the actuation performance value supposing that the selected causal parameters recover from the measurement values to the reference values, and cause the display device to display the computed recovery amount ΔTr

[Math. 9]

$$\Delta T_r = Q_a\left(\frac{1}{N \cdot q - Q_l - Q_b} - \frac{1}{N' \cdot q' - Q_l' - Q_b'}\right), \quad (9)$$

supposing here that

N' is the reference value Nn in a case where the rotation speed of the hydraulic pump is selected from the plurality of causal parameters, and is the measurement value N in a case where the rotation speed of the hydraulic pump is not selected from the plurality of causal parameters, q' is the reference value qn in a case where the delivery capacity of the hydraulic pump is selected from the plurality of causal parameters, and is the measurement value q in a case where the delivery capacity of the hydraulic pump is not selected from the plurality of causal parameters, Ql' is the reference value Qln in a case where the leakage flow rate of the hydraulic working fluid is selected from the plurality of causal parameters, and is the measurement value Q1 in a case where the leakage flow rate of the hydraulic working fluid is not selected from the plurality of causal parameters, and Qb' is the reference value Qbn in a case where the bleed-off flow rate is selected from the plurality of causal parameters, and is the measurement value Qb in a case where the bleed-off flow rate is not selected from the plurality of causal parameters.

* * * * *